US008033598B2

(12) United States Patent
Smith et al.

(10) Patent No.: US 8,033,598 B2
(45) Date of Patent: Oct. 11, 2011

(54) MESH FOLDING CHAIR

(75) Inventors: Richard D. Smith, Spanish Fork, UT (US); Orrin C. Farnsworth, Santaquin, UT (US)

(73) Assignee: Mity-Lite, Inc., Orem, UT (US)

( * ) Notice: Subject to any disclaimer, the term of this patent is extended or adjusted under 35 U.S.C. 154(b) by 163 days.

(21) Appl. No.: 12/422,792

(22) Filed: Apr. 13, 2009

(65) Prior Publication Data

US 2010/0156148 A1 Jun. 24, 2010

Related U.S. Application Data

(60) Provisional application No. 61/140,756, filed on Dec. 24, 2008.

(51) Int. Cl.
*A47C 4/00* (2006.01)

(52) U.S. Cl. ..... 297/55; 297/440.11; 297/440.2; 297/440.21

(58) Field of Classification Search ..... 297/55, 297/440.11, 60, 335, 440.2, 440.21
See application file for complete search history.

(56) References Cited

U.S. PATENT DOCUMENTS

| | | | |
|---|---|---|---|
| 30,858 | A | 12/1860 | Pratt |
| 71,045 | A | 11/1867 | Nicolai |
| 105,253 | A | 7/1870 | Rodgers |
| 116,811 | A | 7/1871 | Collignon |
| 128,767 | A | 7/1872 | Viele |
| 133,503 | A | 11/1872 | Travis et al. |
| 157,028 | A | 11/1874 | Savoral |
| 169,748 | A | 11/1875 | Wakefield |
| 190,827 | A | 5/1877 | Closterman, Jr. |
| 198,421 | A | 12/1877 | Smith |
| 210,842 | A | 12/1878 | Dick |
| 276,881 | A | 5/1883 | Roberts |
| 328,838 | A | 10/1885 | Chichester |
| 451,556 | A | 5/1891 | Hallett |
| 473,704 | A | 1/1892 | Le Count |
| 481,816 | A | 8/1892 | Perry |
| 504,446 | A | 9/1893 | Dodd |
| 77,327 | A | 1/1905 | Stiggleman |

(Continued)

FOREIGN PATENT DOCUMENTS

| | | |
|---|---|---|
| DE | 4135603 | 5/1992 |

(Continued)

OTHER PUBLICATIONS

Smith, Richard et al., U.S. Appl. No. 12/748,823, filed Mar. 29, 2010.

(Continued)

*Primary Examiner* — David Dunn
*Assistant Examiner* — David E Allred
(74) *Attorney, Agent, or Firm* — Thorpe North & Western LLP

(57) ABSTRACT

A folding mesh chair includes a seat and a backrest carried between opposite frame sides. The chair has an unfolded seating position in which the seat pivots to extend from the frame sides and bottoms of front and rear legs move apart, and a folded position in which the seat pivots toward the frame sides and the front and rear legs move together. One or both of the seat and the backrest have a continuous sheet of flexible and elastic mesh or patterned open texture plastic held across and substantially covering an opening in an all-plastic hoop fixed between the frame sides.

25 Claims, 19 Drawing Sheets

U.S. PATENT DOCUMENTS

| | | | |
|---|---|---|---|
| 779,327 | A | 1/1905 | Stiggleman |
| 898,235 | A | 9/1908 | Lloyd |
| 945,032 | A | 1/1910 | Gillespie |
| 976,786 | A | 11/1910 | Moulin |
| 1,181,357 | A | 5/1916 | Thonet |
| 1,291,551 | A | 1/1919 | Kirk |
| 1,355,669 | A | 10/1920 | Henry |
| 1,408,114 | A | 2/1922 | Mathieu |
| 1,591,550 | A | 7/1926 | Rosenthal |
| 1,608,911 | A | 11/1926 | Smith |
| D75,556 | S | 6/1928 | Glantz |
| 1,701,684 | A | 2/1929 | Lee |
| 1,730,916 | A | 10/1929 | Cable |
| 1,740,806 | A | 12/1929 | Clarin |
| 1,746,952 | A | 2/1930 | Marwell |
| 1,789,295 | A | 1/1931 | Bauer |
| 1,815,643 | A | 7/1931 | Allerding |
| 1,825,358 | A | 9/1931 | Scully |
| 1,825,368 | A | 9/1931 | Scully |
| 1,838,213 | A | 12/1931 | Buffington |
| 1,873,768 | A | 8/1932 | Kux |
| 1,874,434 | A | 8/1932 | Brown |
| 1,900,486 | A | 3/1933 | Clarin |
| 1,934,307 | A | 11/1933 | Hardester |
| 1,975,622 | A | 10/1934 | Schermerhom |
| 1,989,865 | A | 2/1935 | Johanson |
| 1,993,601 | A | 3/1935 | Goldberg |
| 2,174,224 | A | 9/1937 | Geller |
| 2,098,888 | A | 11/1937 | Schadler |
| D107,545 | S | 12/1937 | O'Connor |
| 2,126,439 | A | 8/1938 | Zerbee |
| 2,127,710 | A | 8/1938 | Baker |
| 2,186,301 | A | 1/1940 | La More |
| 2,262,500 | A | 11/1941 | Johannsen |
| 2,303,189 | A | 11/1942 | Adler |
| 2,364,093 | A | 12/1944 | O'Connor |
| 2,364,647 | A | 12/1944 | O'Connor |
| 2,381,574 | A | 8/1945 | Clarin |
| 2,514,125 | A | 7/1950 | Evans |
| 2,568,269 | A | 9/1951 | Bumham et al. |
| 3,021,175 | A | 2/1952 | Norquist |
| 2,666,478 | A | 1/1954 | Shwayder |
| 2,699,814 | A | 1/1955 | Kahm |
| 2,706,517 | A | 4/1955 | Dexter et al. |
| 178,900 | A | 10/1956 | O'Neill |
| 2,788,531 | A | 4/1957 | Dye et al. |
| 2,865,437 | A | 12/1958 | Shwayder |
| 2,874,755 | A | 2/1959 | Smith |
| 2,877,829 | A | 3/1959 | Ferar et al. |
| D186,505 | S | 11/1959 | King et al. |
| 2,924,830 | A | 2/1960 | De Long |
| 2,964,092 | A | 12/1960 | Rassier |
| 2,982,339 | A | 5/1961 | Clarin |
| 3,001,816 | A | 9/1961 | Clarin |
| 3,009,738 | A | 11/1961 | Piker |
| 3,025,102 | A | 3/1962 | Nash |
| 3,031,227 | A | 4/1962 | Van Buren, Jr. |
| 3,057,660 | A | 10/1962 | Schneider |
| 3,059,919 | A | 10/1962 | Marchino |
| 3,087,755 | A | 4/1963 | Boman |
| 3,094,357 | A | 6/1963 | Shwayder |
| 3,111,344 | A | 11/1963 | Hoven et al. |
| 3,123,399 | A | 3/1964 | Wilson |
| 3,125,156 | A | 3/1964 | Grimshaw |
| 3,133,762 | A | 5/1964 | Newman |
| 3,159,425 | A | 12/1964 | Engstrom |
| 3,165,359 | A | 1/1965 | Ashkouti |
| D200,532 | S | 3/1965 | Williams |
| D202,264 | S | 9/1965 | Albinson |
| 3,205,010 | A | 9/1965 | Schick |
| 3,207,551 | A | 9/1965 | Axtell |
| 3,220,764 | A | 11/1965 | Duer |
| 3,227,487 | A | 1/1966 | Blanchard, Jr. et al. |
| 3,233,885 | A | 2/1966 | Propst |
| 3,246,927 | A | 4/1966 | Klassen |
| 3,246,928 | A | 4/1966 | Haynes et al. |
| 3,278,227 | A | 10/1966 | Rowland |
| 3,291,523 | A | 12/1966 | Kreuger |
| 3,291,529 | A | 12/1966 | Straits |
| 3,363,943 | A | 1/1968 | Getz et al. |
| 3,383,738 | A | 5/1968 | Fox et al. |
| 3,402,963 | A | 9/1968 | Fujioka et al. |
| 3,419,295 | A | 12/1968 | Small |
| 3,463,547 | A | 8/1969 | Brennan et al. |
| 3,529,866 | A | 9/1970 | Getz |
| 3,531,157 | A | 9/1970 | Duckett et al. |
| 3,540,776 | A | 11/1970 | Wilson |
| 3,586,277 | A | 6/1971 | Voris, Jr. |
| 3,610,686 | A | 10/1971 | Caruso |
| 3,614,157 | A | 10/1971 | Hendrickson et al. |
| 3,630,572 | A | 12/1971 | Homler |
| 3,639,001 | A | 2/1972 | Anderson |
| 3,669,496 | A | 6/1972 | Chisholm |
| 3,669,497 | A | 6/1972 | Massonnet |
| 3,695,687 | A | 10/1972 | Uyeda |
| 3,695,694 | A | 10/1972 | Mohr |
| 3,695,964 | A | 10/1972 | Shaines et al. |
| 3,697,130 | A | 10/1972 | Barecki et al. |
| 3,708,202 | A | 1/1973 | Barecki et al. |
| 3,712,666 | A | 1/1973 | Stoll |
| 3,730,465 | A | 5/1973 | Gonzalez |
| 3,755,853 | A | 9/1973 | Barile |
| 3,758,155 | A | 9/1973 | Straits |
| 3,774,967 | A | 11/1973 | Rowland |
| 3,802,734 | A | 4/1974 | Lindley |
| 3,813,149 | A * | 5/1974 | Lawrence et al. ..... 297/335 |
| 3,838,884 | A | 10/1974 | Faiks et al. |
| 3,840,269 | A | 10/1974 | Ambrose |
| 3,844,517 | A | 10/1974 | Fraser |
| 3,845,984 | A | 11/1974 | Rowland |
| 3,847,433 | A | 11/1974 | Acton et al. |
| 3,899,207 | A | 8/1975 | Mueller |
| 3,904,242 | A | 9/1975 | Koepke et al. |
| 3,906,592 | A | 9/1975 | Sakasegawa et al. |
| 3,924,893 | A | 12/1975 | Ferrara |
| 3,939,565 | A | 2/1976 | Bush |
| 4,057,288 | A | 11/1977 | Schwartz et al. |
| 4,062,589 | A | 12/1977 | Klein et al. |
| 4,064,815 | A | 12/1977 | Baum |
| 4,066,295 | A | 1/1978 | Severson |
| D249,417 | S | 9/1978 | Ambasz |
| 4,155,592 | A | 5/1979 | Tsuda et al. |
| 4,235,473 | A | 11/1980 | Aginar |
| 4,278,287 | A | 7/1981 | Homestead |
| 4,291,855 | A | 9/1981 | Schenkel et al. |
| 4,318,570 | A | 3/1982 | Adam et al. |
| 4,319,779 | A | 3/1982 | Leonhart |
| 4,325,577 | A | 4/1982 | Thebaud |
| 4,359,809 | A | 11/1982 | Fraser |
| 4,368,917 | A | 1/1983 | Urai |
| 4,382,453 | A | 5/1983 | Bujan et al. |
| 4,383,486 | A | 5/1983 | Reineman et al. |
| 4,386,804 | A | 6/1983 | Ware et al. |
| 4,400,031 | A | 8/1983 | DeDecker |
| 4,407,479 | A | 10/1983 | Combe |
| 4,451,085 | A | 5/1984 | Franck et al. |
| 4,456,296 | A | 6/1984 | Rowland |
| D275,533 | S | 9/1984 | Lantz |
| 4,498,702 | A | 2/1985 | Raftery |
| 4,502,731 | A | 3/1985 | Snider |
| 4,510,634 | A | 4/1985 | Diedrich et al. |
| 4,533,174 | A | 8/1985 | Fleishman |
| 4,541,150 | A | 9/1985 | Brokmann |
| 4,549,764 | A | 10/1985 | Haedo |
| 4,557,521 | A | 12/1985 | Lange |
| 4,558,904 | A | 12/1985 | Schultz |
| 4,561,622 | A | 12/1985 | Heinzel |
| 4,564,163 | A | 1/1986 | Barnett |
| 4,569,496 | A | 2/1986 | Fleishman |
| 4,580,836 | A | 4/1986 | Verney |
| 4,583,778 | A | 4/1986 | Liebhold |
| 4,585,272 | A | 4/1986 | Ballarini |
| 4,601,516 | A | 7/1986 | Klein |
| 4,603,904 | A | 8/1986 | Tolleson et al. |
| 4,603,907 | A | 8/1986 | Witzke |
| 4,617,869 | A | 10/1986 | Denomey |
| 4,624,432 | A | 11/1986 | Salacuse |

4,630,865 A 12/1986 Ahs
4,639,042 A 1/1987 Lange
4,648,653 A 3/1987 Rowland
4,655,504 A 4/1987 Weber
4,660,887 A 4/1987 Fleming et al.
D290,070 S 6/1987 Lange
4,684,172 A 8/1987 Lundquist
4,747,569 A 5/1988 Hoshino
4,756,575 A 7/1988 Dicks
4,790,595 A 12/1988 Hensel et al.
D300,885 S 5/1989 Ochsner
4,830,250 A 5/1989 Newbold et al.
4,837,878 A 6/1989 Huemer
4,852,944 A 8/1989 Hartmann
4,869,552 A 9/1989 Tolleson et al.
4,881,705 A 11/1989 Kraus
4,883,320 A 11/1989 Izumida et al.
4,913,493 A 4/1990 Heidmann
4,923,158 A 5/1990 Saisho
4,953,913 A 9/1990 Graebe
4,962,964 A 10/1990 Snodgrass
4,978,168 A 12/1990 Piretti
5,002,337 A 3/1991 Engel et al.
5,013,089 A 5/1991 Abu-Isa et al.
5,020,749 A 6/1991 Kraus
5,039,163 A 8/1991 Tolleson
5,040,848 A 8/1991 Irie et al.
5,056,699 A 10/1991 Newbold et al.
5,062,179 A 11/1991 Huang
5,064,247 A 11/1991 Clark et al.
5,071,191 A 12/1991 Leib
5,096,259 A 3/1992 Stanfield
5,108,149 A 4/1992 Ambasz
5,110,186 A 5/1992 Clark et al.
5,113,717 A 5/1992 Plamper
5,123,702 A 6/1992 Caruso
5,131,607 A 7/1992 Arnold et al.
5,146,656 A 9/1992 Huang
5,154,485 A 10/1992 Fleishman
5,183,314 A 2/1993 Lorbiecki
5,211,323 A 5/1993 Chimenti et al.
5,213,004 A 5/1993 Hoblingre
D337,444 S 7/1993 Lamalle
5,234,185 A 8/1993 Hoffman et al.
5,265,969 A 11/1993 Chuang
5,277,387 A 1/1994 Lewis et al.
5,282,669 A 2/1994 Barile
5,297,851 A 3/1994 Van Hekken
5,323,713 A 6/1994 Luyk et al.
5,356,204 A 10/1994 McDonough
5,367,815 A 11/1994 Liou
5,382,080 A 1/1995 Gamberini et al.
5,383,712 A 1/1995 Perry
5,393,126 A 2/1995 Boulva
D357,365 S 4/1995 Ward et al.
5,413,015 A 5/1995 Zentmyer
5,497,537 A 3/1996 Robinson et al.
5,499,883 A 3/1996 Heinzel
5,503,455 A 4/1996 Yang
5,513,899 A 5/1996 Michaels et al.
5,520,474 A 5/1996 Liu
5,524,963 A 6/1996 Barile
5,524,966 A 6/1996 Piretti
5,542,159 A 8/1996 Schultz et al.
5,549,358 A 8/1996 Muller
5,560,678 A 10/1996 Eppelt
5,611,598 A 3/1997 Knoblock
5,662,383 A 9/1997 Hand
5,681,093 A 10/1997 Pfister
5,738,408 A 4/1998 Wu
5,747,140 A 5/1998 Heerklotz
5,762,403 A 6/1998 Robinson
5,779,317 A 7/1998 Neal
5,785,287 A 7/1998 Hoshino
5,820,221 A 10/1998 Greaves et al.
5,825,095 A 10/1998 Albecker, III
5,826,312 A 10/1998 Schroder et al.
5,842,739 A 12/1998 Noble
5,845,589 A 12/1998 Pfister
5,845,970 A 12/1998 Schwartz
5,860,697 A 1/1999 Fewchuk
5,860,700 A 1/1999 Lance
5,863,096 A 1/1999 Bartlmae
5,871,258 A 2/1999 Battey et al.
D406,195 S 3/1999 Gamberini
5,887,946 A 3/1999 Raftery
5,902,012 A 5/1999 Han
5,904,397 A 5/1999 Fismen
5,934,758 A 8/1999 Ritch et al.
5,947,562 A 9/1999 Christofferson et al.
5,954,391 A 9/1999 Gray
5,961,184 A 10/1999 Balderi et al.
5,964,443 A 10/1999 Leveille
5,967,605 A 10/1999 Stanfield
5,975,626 A 11/1999 Aycock
5,975,634 A 11/1999 Knoblock et al.
5,988,746 A 11/1999 Raftery
5,988,757 A 11/1999 Vishey et al.
5,997,084 A 12/1999 Barile et al.
6,003,948 A 12/1999 Holbrook
D418,322 S 1/2000 Hock
6,012,679 A 1/2000 Auestad
6,030,037 A 2/2000 Ritch et al.
6,035,901 A 3/2000 Stumpf et al.
6,050,646 A 4/2000 Stenzel et al.
D425,717 S 5/2000 Tseng
6,056,354 A 5/2000 Tseng
6,059,368 A * 5/2000 Stumpf et al. ..... 297/440.11
6,065,803 A 5/2000 Li et al.
6,070,940 A 6/2000 Wu
6,095,597 A 8/2000 Huang
6,099,073 A 8/2000 Bruschi
6,102,482 A 8/2000 Dettoni et al.
6,106,061 A 8/2000 Caruso et al.
6,113,186 A 9/2000 Holmes et al.
6,116,692 A 9/2000 Tarnay et al.
6,116,694 A 9/2000 Bullard
D431,400 S 10/2000 Grove
D432,805 S 10/2000 Smith
6,125,521 A 10/2000 Stumpf et al.
6,135,562 A 10/2000 Infanti
D435,977 S 1/2001 Ambasz
D436,457 S 1/2001 Ambasz
6,206,469 B1 3/2001 Caruso et al.
D440,784 S 4/2001 Ambasz
6,234,571 B1 5/2001 Atkins et al.
6,234,578 B1 5/2001 Barton et al.
6,254,190 B1 7/2001 Gregory
D446,661 S 8/2001 Ambasz
6,279,991 B1 8/2001 Atkins et al.
6,279,998 B1 8/2001 Chu et al.
6,305,742 B1 10/2001 Spendlove et al.
6,305,750 B1 10/2001 Buono et al.
D452,619 S 1/2002 Piretti
6,338,587 B1 * 1/2002 Kuo ..... 403/109.7
6,345,863 B1 2/2002 Laws et al.
6,349,992 B1 2/2002 Knoblock et al.
6,378,944 B1 * 4/2002 Weisser ..... 297/440.11
6,382,728 B1 5/2002 Buono
6,386,627 B1 5/2002 Tsai
6,386,634 B1 5/2002 Stumpf et al.
6,406,096 B1 6/2002 Barile, Sr.
6,409,268 B1 6/2002 Cvek
D460,300 S 7/2002 Fifield et al.
6,412,869 B1 7/2002 Pearce
6,422,645 B1 7/2002 Smith et al.
6,439,665 B1 8/2002 Cvek
6,471,293 B2 10/2002 Ware et al.
D465,938 S 11/2002 Huang
D465,940 S 11/2002 Nien
6,481,789 B1 * 11/2002 Ambasz ..... 297/55
D466,712 S 12/2002 Haney et al.
D469,969 S 2/2003 Glass et al.
D469,971 S 2/2003 Piretti
6,523,898 B1 2/2003 Ball et al.
6,533,352 B1 3/2003 Glass et al.
6,536,079 B2 3/2003 Hill
D473,727 S 4/2003 Tsai

| | | | | |
|---|---|---|---|---|
| 6,543,842 | B2 | 4/2003 | Haney | |
| 6,547,321 | B2 | 4/2003 | Wu | |
| 6,550,866 | B1 | 4/2003 | Su | |
| 6,561,580 | B1 | 5/2003 | Bergey | |
| D476,162 | S | 6/2003 | Finazzi | |
| D477,470 | S | 7/2003 | Haney et al. | |
| 6,585,323 | B2 | 7/2003 | Gaylord et al. | |
| 6,588,842 | B2 | 7/2003 | Stumpf et al. | |
| 6,598,544 | B2 | 7/2003 | Laws et al. | |
| 6,604,784 | B1 | 8/2003 | Bosman et al. | |
| 6,612,654 | B2 | 9/2003 | Laws et al. | |
| D481,879 | S | 11/2003 | Su | |
| 6,644,749 | B2 * | 11/2003 | VanDeRiet et al. | 297/440.1 |
| 6,669,281 | B1 * | 12/2003 | Huang | 297/58 |
| 6,688,698 | B1 | 2/2004 | Chou et al. | |
| 6,702,390 | B2 | 3/2004 | Stumpf et al. | |
| 6,709,050 | B2 * | 3/2004 | Huang | 297/57 |
| 6,722,741 | B2 | 4/2004 | Stumpf et al. | |
| 6,722,742 | B2 | 4/2004 | Potes et al. | |
| 6,726,285 | B2 | 4/2004 | Caruso et al. | |
| 6,726,286 | B2 | 4/2004 | Stumpf et al. | |
| 6,729,691 | B2 | 5/2004 | Koepke et al. | |
| 6,733,080 | B2 * | 5/2004 | Stumpf et al. | 297/411.36 |
| 6,742,839 | B2 * | 6/2004 | Piretti | 297/239 |
| 6,755,468 | B1 * | 6/2004 | Pan | 297/335 |
| D494,792 | S | 8/2004 | Schmitz et al. | |
| 6,779,846 | B2 | 8/2004 | Spendlove et al. | |
| D495,509 | S | 9/2004 | Breen | |
| D495,891 | S | 9/2004 | Ambasz | |
| 6,837,546 | B2 * | 1/2005 | VanDeRiet et al. | 297/440.1 |
| D501,613 | S | 2/2005 | Kaltenmark et al. | |
| D503,291 | S | 3/2005 | Lucci et al. | |
| 6,863,341 | B1 | 3/2005 | Wen | |
| 6,866,338 | B2 | 3/2005 | Mendenhall et al. | |
| 6,871,906 | B2 | 3/2005 | Haney | |
| 6,886,890 | B2 | 5/2005 | Rowland et al. | |
| 6,890,026 | B1 | 5/2005 | Shin | |
| 6,899,053 | B2 | 5/2005 | Hawkins | |
| 6,899,396 | B2 | 5/2005 | Bales | |
| D505,800 | S | 6/2005 | Lucci et al. | |
| D506,325 | S * | 6/2005 | Farber et al. | D6/368 |
| 6,908,159 | B2 | 6/2005 | Prince et al. | |
| D507,425 | S | 7/2005 | Ashby et al. | |
| 6,923,505 | B2 | 8/2005 | Siminovitch et al. | |
| 6,935,698 | B1 | 8/2005 | Chen | |
| 6,942,300 | B2 * | 9/2005 | Numa et al. | 297/452.56 |
| 6,957,861 | B1 | 10/2005 | Chou et al. | |
| 6,966,606 | B2 | 11/2005 | Coffield | |
| D513,456 | S | 1/2006 | Smith | |
| 6,983,997 | B2 | 1/2006 | Wilkerson et al. | |
| 6,988,774 | B1 | 1/2006 | Elzenbeck | |
| 7,021,712 | B2 | 4/2006 | Spendlove et al. | |
| 7,029,064 | B2 * | 4/2006 | Chen | 297/16.1 |
| D523,254 | S | 6/2006 | Nye et al. | |
| 7,059,670 | B2 | 6/2006 | Mills et al. | |
| 7,066,536 | B2 * | 6/2006 | Williams et al. | 297/250.1 |
| 7,066,550 | B1 | 6/2006 | Su | |
| 7,073,864 | B2 | 7/2006 | Olsen | |
| 7,104,604 | B1 | 9/2006 | Kang | |
| 7,107,915 | B2 | 9/2006 | Laws et al. | |
| 7,111,906 | B2 | 9/2006 | Heisey et al. | |
| D533,000 | S | 12/2006 | Lu et al. | |
| 7,147,286 | B2 | 12/2006 | Cesaroni et al. | |
| 7,152,929 | B2 | 12/2006 | Wu | |
| 7,156,459 | B2 | 1/2007 | Ambasz | |
| D539,557 | S | 4/2007 | Doughty | |
| D544,225 | S | 6/2007 | Cantarutti | |
| D544,235 | S | 6/2007 | Chen | |
| 7,249,802 | B2 | 7/2007 | Schmitz et al. | |
| 7,303,230 | B2 * | 12/2007 | Munn et al. | 297/255 |
| 7,303,235 | B1 * | 12/2007 | Fongers | 297/337 |
| D558,999 | S | 1/2008 | Cantarutti et al. | |
| D567,524 | S | 4/2008 | Marin | |
| D569,121 | S | 5/2008 | Rizzi | |
| 7,396,076 | B1 | 7/2008 | Hock | |
| 7,396,078 | B2 | 7/2008 | Weber et al. | |
| 7,406,733 | B2 | 8/2008 | Coffield et al. | |
| D581,708 | S | 12/2008 | Su | |
| 7,458,918 | B1 * | 12/2008 | Clark | 482/57 |
| 7,472,962 | B2 | 1/2009 | Caruso et al. | |
| 7,513,567 | B2 * | 4/2009 | Huang | 297/16.1 |
| D594,669 | S | 6/2009 | Asano | |
| 7,552,968 | B2 | 6/2009 | Smith et al. | |
| D599,127 | S * | 9/2009 | Smith | D6/368 |
| D600,936 | S | 9/2009 | Koh | |
| 7,717,511 | B2 | 5/2010 | Huang | |
| 7,758,112 | B2 | 7/2010 | Huang | |
| 7,896,431 | B2 * | 3/2011 | Cui et al. | 297/16.1 |
| 2001/0028188 | A1 | 10/2001 | Stumpf et al. | |
| 2001/0030457 | A1 | 10/2001 | Gregory | |
| 2001/0033100 | A1 * | 10/2001 | Haney | 297/55 |
| 2002/0053822 | A1 | 5/2002 | Ware et al. | |
| 2002/0117883 | A1 | 8/2002 | Gevaert | |
| 2002/0145326 | A1 | 10/2002 | Liu | |
| 2002/0195863 | A1 | 12/2002 | Su | |
| 2003/0071509 | A1 * | 4/2003 | Neil et al. | 297/440.11 |
| 2003/0127887 | A1 | 7/2003 | Laws et al. | |
| 2003/0168894 | A1 * | 9/2003 | Lin | 297/55 |
| 2003/0234563 | A1 | 12/2003 | Huang | |
| 2004/0076465 | A1 | 4/2004 | Geiger | |
| 2004/0245842 | A1 | 12/2004 | Nardi | |
| 2004/0262975 | A1 | 12/2004 | Su | |
| 2005/0001464 | A1 | 1/2005 | Caruso et al. | |
| 2005/0077773 | A1 | 4/2005 | Chen | |
| 2005/0146193 | A1 | 7/2005 | Shieh | |
| 2005/0175403 | A1 | 8/2005 | Herb et al. | |
| 2005/0206210 | A1 | 9/2005 | Coffield | |
| 2005/0264087 | A1 | 12/2005 | Diffrient | |
| 2006/0006715 | A1 | 1/2006 | Chadwick et al. | |
| 2006/0091715 | A1 * | 5/2006 | Schmitz et al. | 297/411.36 |
| 2006/0138849 | A1 * | 6/2006 | Wilkerson et al. | 297/452.56 |
| 2006/0284469 | A1 | 12/2006 | Lowsky | |
| 2007/0000112 | A1 * | 1/2007 | Johnson et al. | 29/91.1 |
| 2007/0132291 | A1 | 6/2007 | Smith et al. | |
| 2007/0132302 | A1 | 6/2007 | Smith et al. | |
| 2007/0222266 | A1 | 9/2007 | Lucci et al. | |
| 2008/0315645 | A1 | 12/2008 | Hock | |
| 2008/0315646 | A1 | 12/2008 | Hock | |
| 2009/0079235 | A1 | 3/2009 | Huang | |
| 2009/0146467 | A1 * | 6/2009 | Waite et al. | 297/55 |
| 2009/0184548 | A1 | 7/2009 | Vickers et al. | |
| 2009/0236895 | A1 * | 9/2009 | Bottemiller | 297/440.11 |
| 2010/0176633 | A1 | 7/2010 | Brncick et al. | |
| 2010/0194160 | A1 * | 8/2010 | Machael et al. | 297/239 |
| 2010/0237582 | A1 * | 9/2010 | Belenkov et al. | 280/220 |
| 2011/0025104 | A1 * | 2/2011 | Fusao et al. | 297/55 |

FOREIGN PATENT DOCUMENTS

| | | |
|---|---|---|
| EP | 210710 | 2/1987 |
| JP | 06269330 | 9/1994 |
| WO | WO 2004/037046 | 5/2004 |

OTHER PUBLICATIONS

Smith, Richard et al., U.S. Appl. No. 29/346,705, filed Nov. 4, 2009.
Smith, Richard et al., U.S. Appl. No. 12/612,257, filed Nov. 4, 2009.
Smith, Richard et al., U.S. Appl. No. 12/755,954, filed Apr. 7, 2010.
Smith, Richard et al., U.S. Appl. No. 12/755,995, filed Apr. 7, 2010.
Smith, Richard et al., U.S. Appl. No. 12/612,252, filed Nov. 4, 2009.
Smith, Richard et al., U.S. Appl. No. 12/757,218, filed Apr. 9, 2010.
Herman Miller for business—Mirra Chairs, www.hermanmiller.com/CDA/SSA/Product?0,,a10-c440-p205,00.html, accessed Apr. 8. 2009, 2pages.
Home Alexander Folding Rockers Set of 2: Target, www.target.com/Home-Alexander-Folding-Rockers-Set/dp/B001CS96AY/qid=1233... accessed Jan. 29, 2009, 4 pages.
Ergo Mesh Folding Guest Chair (Set of 2) from Overstock.com, www.overstock.com/Office-Furniture/Ergo-Mesh-Folding-Guest-Chair-Set of 2/308..., accessed Jan. 29, 2009 3 pages.
Mesh folding chair, mesh chairs, custom chairs, folding camp chairs, custom foldin . . . , www.staplespromotionalproducts.com/ProductDetail.aaspx?id=358, accessed Jan. 29, 2009, 1 page.
Home wrought iron fold chair—set of 4: Target, www.target.com/Home-Wrought-Iron-Fold-Chari/dp/B001IZS8WS/qid=123326645.., accessed Jan. 29, 2009 2 pages.
Herman Miller—for buisness-aeron chairs, www.hermanmiller.com/CDA/SSA/Product/1,1592,a10-c440-p8,00.html, accessed Jan. 29, 2009, 4 pages.

Aeron chairs, Herman Miller aeron chair. aeron loaded chairs & aeron chair accesso . . . , www.hermanmillerseating.com/aeron%AE-C79906.html?refid=G2772.%22herman... accessed Jan. 29, 2009, 4 pages.
Smith, Richard et al., U.S. Appl. No. 12/422,801, filed Apr. 13, 2009.
Smith, Richard et al., U.S. Appl. No. 12/422,811, filed Apr. 13, 2009.
Smith, Richard et al., U.S. Appl. No. 12/422,821, filed Apr. 13, 2009.
Smith, Richard et al., U.S. Appl. No. 29/335,295, filed Apr. 13, 2009.
http://stores.advancedinteriordesigns.com/-strse-972/Mesh-Folding-Chair,-Suave/Detail.bok, Advanced Interior Designs—Modern Home and Office Furniture, accessed Oct. 2009, 1 page.
DuraMesh Folding Chair, KI A versatile folding chair with a comfortable, durable mesh seat, www.ki.com, accessed Oct. 2009, 2 pages.
U.S. Appl. No. 29/346,705, filed Nov. 4, 2009; Richard D. Smith; office action issued Feb. 3, 2011.
U.S. Appl. No. 12/422,821, filed Apr. 13, 2009; Richard D. Smith; office action issued Jan. 7, 2011.
U.S. Appl. No. 12/422,801, filed Apr. 13, 2009; Richard D. Smith; office action issued Jan. 19, 2011.
U.S. Appl. No. 12/422,811, filed Apr. 13, 2009; Richard D. Smith; office action issued Jan. 24, 2011.
U.S. Appl. No. 12/422,811; filing date Apr. 13, 2009; Richard D. Smith; Notice of Allowance issued Jun. 29, 2011.
U.S. Appl. No. 12/422,821; filing date Apr. 13, 2009; Richard D. Smith; Notice of Allowance issued Jul. 7, 2011.
U.S. Appl. No. 12/422,801; filing date Apr. 13, 2009; Richard D. Smith; Notice of Allowance issued Jul. 13, 2011.
U.S. Appl. No. 29/346,705; filing date Nov. 4, 2009; Richard D. Smith; Notice of Allowance issued Jul. 18, 2011.

* cited by examiner

MESH FOLDING CHAIR

PRIORITY CLAIM(S)

Priority of U.S. Provisional Patent Application Ser. No. 61/140,756, filed on Dec. 24, 2008, is claimed; and is hereby incorporated herein by reference in its entirety.

RELATED APPLICATION(S)/PATENTS

This is related to U.S. Design application Ser. No. 29/335,295 filed Apr. 13, 2009; U.S. patent application Ser. No. 12/422,801, filed Apr. 13, 2009, entitled "Comfortable Mesh Folding Chair"; U.S. patent application Ser. No. 12/422,811, filed Apr. 13, 2009, entitled "Folding and Stacking Mesh Chair System"; U.S. patent application Ser. No. 12/422,821, filed Apr. 13, 2009, entitled "Folding Mesh Chair with Nesting Hoops"; all of which are incorporated herein by reference in their entirety.

BACKGROUND

1. Field of the Invention

The present invention relates generally to folding chairs. More particularly, the present invention relates to a mesh folding chair.

2. Related Art

Folding chairs are often used in situations in which it is desirable or necessary to provide varying numbers and/or varying layouts of chairs, such as during conventions, seminars, conferences, etc. In addition, folding chairs are often used in multipurpose areas in which patron seating is required for some functions, but a large open space is required for other functions necessitating storage of the chairs. For example, some organizations have buildings with a multipurpose room which may be used for banquets, seminars, conventions, etc., with chairs set up, or for a dance, sporting event, etc., with the folding chairs removed. Furthermore, folding chairs are often used domestically/residentially to accommodate larger dinner-parties or the like.

It is desirable that the folding chairs be capable of being folded and stacked for storage so that the chairs take up less room when they are not required. It will be appreciated that some situations or events will require thousands of folding chairs, all of which may need to be folded and stored at any given period. Thus, the chairs must be folded and stored such that they have a high storage density to minimize the storage space required. It will be appreciated that any extra thickness of a chair when folded becomes significant when numerous folding chairs are involved. For example, with a thousand stacked folding chairs, a folding chair which saves one extra inch in the folded position results in over 80 linear feet of saved storage space. In addition, it will be appreciated that numerous stacked chairs can be difficult to handle or store, and may separate from one another. Furthermore, it will be appreciated that chairs can be unsymmetrical so that stacking several chairs together results in a non-linear stack which can lead to separation.

One disadvantage with many prior art folding chairs is the bulk or thickness of the chair in the folded position. Many typical folding chairs still remain several inches thick in the folded position, and thus are less dense when stored. For example, many typical folding chairs have seats which fold adjacent to or abut the legs, such that the thickness of the chairs in the folded position comprises the thickness of the legs and the seat.

In addition, it is desirable that the folding chairs be easily storable or stackable, and be stable when stored/stacked. Many typical prior art folding chairs are stored merely by leaning one chair against a wall and subsequent chairs in a series against the first chair. It will be appreciated that a plurality of folding chairs stacked against a wall has a potential domino effect, with all of the chairs subject to being knocked over. Other prior art folding chairs have complicated and expensive hanging rack systems. For example, a wheeled cart might have a plurality of support arms from which a plurality of folding chairs is suspended. One disadvantage of these types of systems is that chairs on the end of the hangers tend to fall off the rack, and the wheeled racks are difficult to move and maneuver.

It also is desirable that the chairs be comfortable. Typical prior art folding chairs have rigid metal seats and seat backs which can be hard and uncomfortable. One disadvantage of many prior art folding chairs is that the chairs either fold well and are uncomfortable, or are comfortable but are awkward in folding. Thus, there tends to be a trade off between comfort and foldability. Some chairs provide a cushion. But these chairs still utilize the rigid metal seat bottoms and seat backs, and the cushions tend to make the chairs even thicker when folded. For example, see U.S. Pat. Nos. 2,877,829 and D357,365.

Other types of chairs, such as office chairs, have been design for greater comfort and aesthetic appearance, but which do not fold or stack. For example, see U.S. Pat. Nos. 6,125,521 and 7,249,802.

SUMMARY OF THE INVENTION

It has been recognized that it would be advantageous to develop a folding chair with greater comfort while maintaining high density storage. In addition, it has been recognized that it would be advantageous to develop a chair utilizing a mesh seating surface for comfort and space saving in a folding chair. In addition, it has been recognized that it would be advantageous to develop a chair utilizing the comfort of a mesh seating surface in a folding and stacking chair. In addition, it has been recognized that it would be advantageous to develop such a folding and stacking chair with a mesh seating surface that is both economically viable and structurally sound.

The invention provides a folding chair including a seat and a backrest carried between opposite frame sides each with a backrest support, a front leg and a rear leg. In an unfolded seating position, the seat pivots to extend from the frame sides and bottoms of the front and rear legs move apart. In a folded position, the seat pivots toward the frame sides and the front and rear legs move together. One or both of the seat and the backrest have a continuous sheet of flexible and elastic mesh or patterned open texture plastic held across and substantially covering an opening in an all-plastic hoop coupled between the frame sides.

In accordance with a more detailed aspect of the present invention, the all-plastic hoop of the backrest and the all-plastic hoop of the seat form the sole structural support between the frame sides above a bottom of the frame sides.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
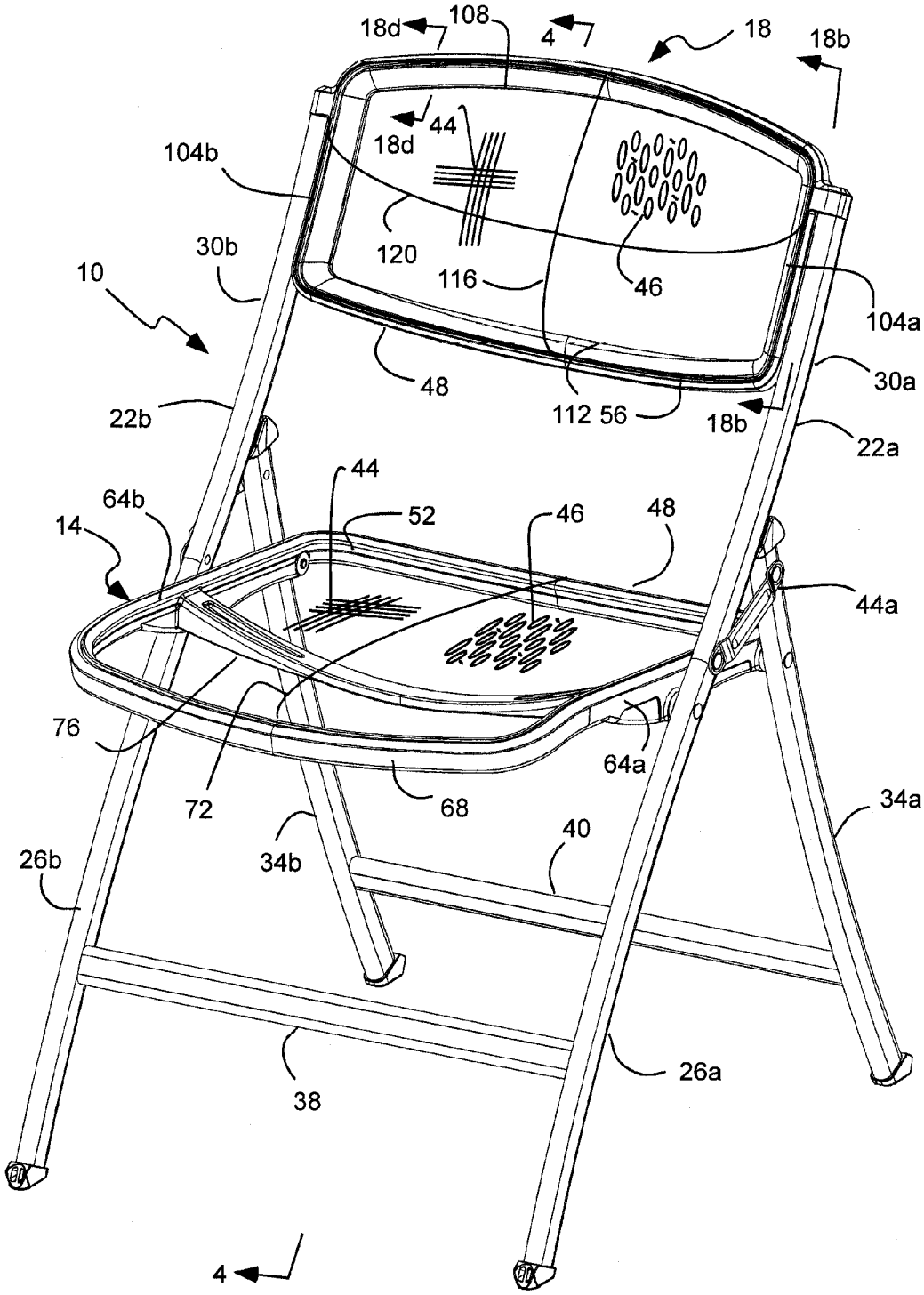
FIG. 1 is a front perspective view of a mesh folding chair in accordance with an embodiment of the present invention shown in an unfolded seating position and with mesh of the seat and backrest mostly removed for clarity.
Figure 2:
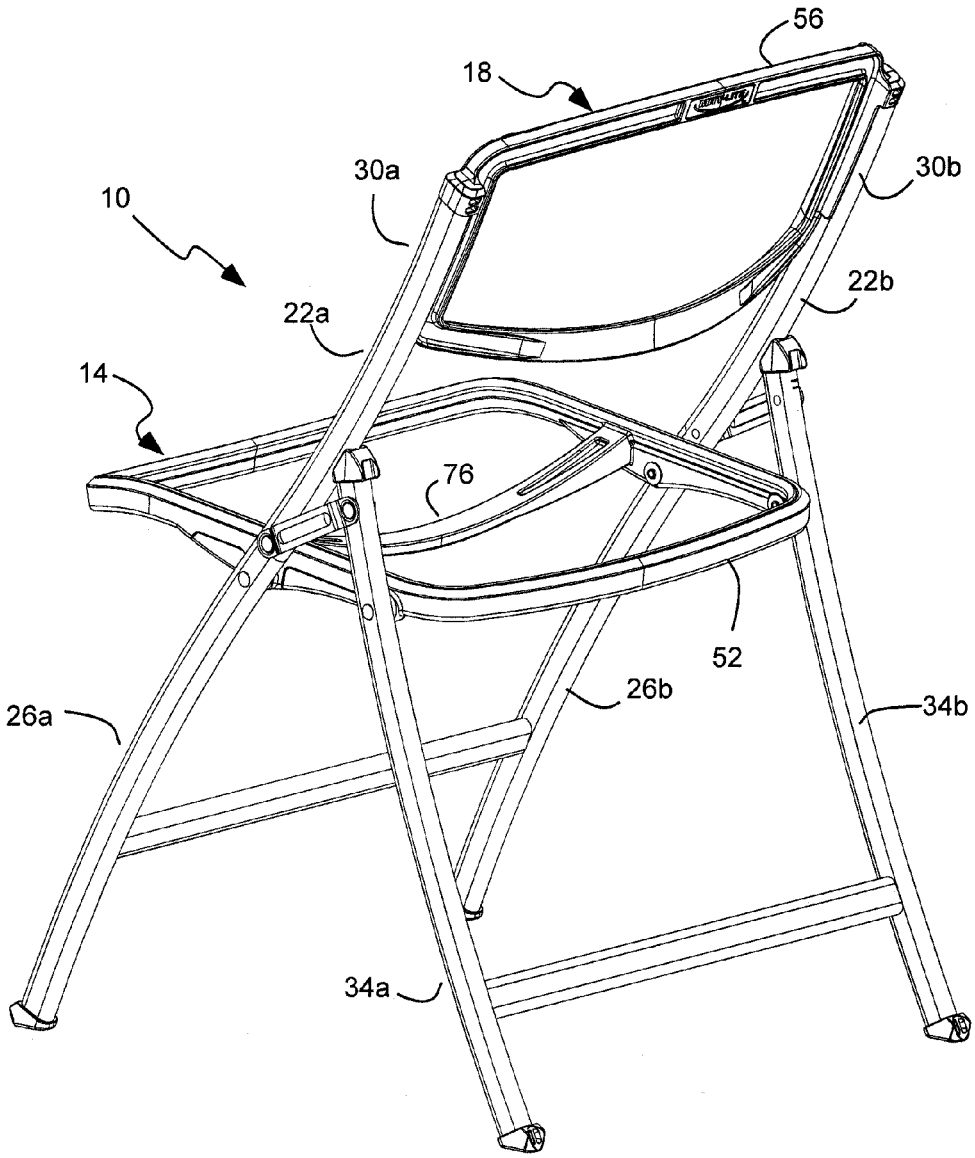
FIG. 2 is a rear perspective view of the mesh folding chair of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIGS. 1-13, a folding chair, indicated generally at 10, with a mesh seat 14 and a mesh backrest 18 is shown in an example implementation in accordance with the invention. Such a folding chair can be utilized by institutions or residentially. The mesh seat and backrest have a stretched mesh over all-plastic frames or hoops to achieve upholstered comfort in a non-upholstered folding chair. In addition, the chair can use the all-plastic frames with mesh for the seat and the backrest supported by a metal frame and legs for a sturdy, strong, and light-weight chair. The seat and the backrest can be plastic and can attach to the frame and legs without metal brackets or the like. Furthermore, the seat can have a broadly curved front and upper edge, or waterfall edge, to resist a hard surface against a backside of a user's leg. Furthermore, the final shape of mesh back provides lumbar support.

The chair 10 can include a frame with opposite frame sides 22*a* and 22*b* that carry the seat and backrest therebetween. The frame sides can each include an elongated member defining a front leg 26*a* and 26*b* with a lower portion thereof, and a backrest support 30*a* and 30*b* with an upper portion thereof. Thus, the backrest support 30*a* and 30*b* is essentially an extension of the front leg 26 and 26*b*. In addition, the opposite side frames can each include a rear leg 34*a* and 34*b*. The frame sides 22*a* and 22*b* can be coupled together by the seat 14 and backrest 18, and by front and rear lower cross members 38 and 40 that extend between the front and rear legs respectively nearer a lower end of the legs. The front and rear legs are pivotally or movably coupled together, and pivot or move with respect to one another. The front and rear legs can be coupled together by the seat 14 and a link 44*a* and 44*b*. Thus, the seat 14 is pivotally coupled to both the front and rear legs. Similarly, the link 44*a* and 44*b* is pivotally coupled to both the front and rear legs. The front and rear legs and the backrest support can be formed of metal, such as steel or aluminum, and can be tubular for lighter weight. The cross-sectional shape of the members and chair legs can be elliptical for added strength. In addition, the members can be curvilinear and can have a stretched s-shaped profile to facilitate stacking. The front and rear legs can have matching curvature so that they can nest adjacent one another. The chair 10 can have an unfolded seating position, as shown in FIGS. 1-7; and a folded position or a folded and stack position, as shown in FIGS. 8-11. In the unfolded seating position, the seat 14 pivots to extend from the frame sides 22*a* and 22*b* and bottoms of the front and rear legs move apart so that the chair rests on a support surface and a user can sit on the seat. In the folded position, the seat 14 pivots toward the frame sides 22*a* and 22*b* and the front and rear legs move together so that the chair can be stored in less space.

Figure 8:
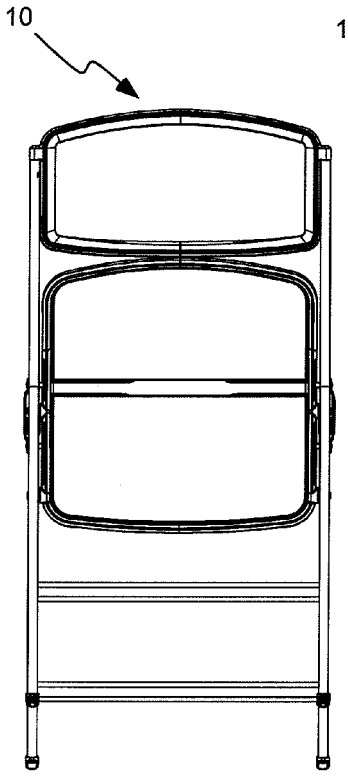
FIG. 8 is a front view of the mesh folding chair of FIG. 1, shown in a folded position.

The seat 14 and the backrest 18 can each have a continuous sheet of flexible and elastic mesh (represented by 44 in FIG. 1) held taut across and substantially cover the seat and backrest. The terms "mesh" and "sheet of mesh" are used interchangeably herein to refer to a mesh material that is a continuous sheet in that it is essentially consistent in its composition of strands and intervening openings (although it may have a pattern therein) and essentially covers the entirety of the seat and/or backrest (as opposed to individual strands or discrete straps with larger openings therebetween); and that is flexible and elastic in that it readily deflects under the weight of a user and returns to its previous position after unloading (as opposed to an embossed metal or rigid screen). A space can separate the seat and the backrest, and can define a gap between the mesh of the seat and the mesh of the backrest. The space can be sized to receive the seat therein in the folded position, as shown in FIG. 8. The mesh material can include a polypropelene mesh fabric or the like. The mesh can be a woven mesh or a knitted mesh. The mesh material can include 70% elastomer monofilament with a 55 durometer and 30% polyester yarn. The elastomeric monofilament can be a polyester co-polymer (such as Hytrel by Dupont). The interwoven monofilaments can also be bonded together to resist unraveling, for example by using a coextruded monofilament with an outer layer having a lower melting point that melts in an oven to bond to adjacent monofilaments. Openings can be formed through the mesh between the strands. The openings, which may have different sizes based on the pattern of the weave, can have substantially the same size, dimension or width of the strands, or be on the same order. Other types of mesh or compositions of strands with less or more elastomer can be used. As stated above, the mesh can be woven or knitted.

Alternatively, the seat 14 and the backrest 18 can each have a continuous sheet of flexible and elastic patterned open texture plastic (represented by 46 in FIG. 1) held across and substantially cover the seat and backrest. The term "sheet of patterned open texture plastic" is used herein to refer to a plastic material that has a series or arrangement of openings across the sheet and that is continuous in that it is essentially consistent in its composition of structure and openings (although it may have a pattern therein) and essentially covers the entirety of the seat and/or backrest. In addition, the sheet of plastic is flexible and elastic in that it readily deflects under the weight of a user and returns to its previous position after unloading (as opposed to an embossed metal or rigid screen). The sheet of plastic and the material of the sheet of plastic can be selected so that the sheet of plastic can deflect or bend. In addition, the openings can be sized and patterned to facilitate deflection or bending, and to eliminate pressure points. The openings and the material between the openings can be substantially the same size, dimension or width, or on the same order. Alternatively, an opening can be elongated and serpentine to substantially traverse a width, depth or height of seat or backrest. Again, a space can separate the seat and the backrest, and can define a gap between the sheet of plastic of the seat and the sheet of plastic of the backrest. The sheet of plastic and the all-plastic hoop can be formed together, such as by injection molding, so that the seat and backrest are manufactured as a single piece or unit. The all-plastic hoop can be distinguished from the sheet of plastic as a thicker perimeter.

In either case, the sheet of mesh or the sheet of plastic can provide the sole or only support of the user's weight. Thus, each side of the sheet of mesh or the sheet of plastic can be free or open, without other materials or fillers, such as foam or cloth.

In one aspect, only the seat can include the mesh supported by a seat frame. In another aspect, only the backrest can include the mesh supported between the backrest supports of the frame sides or a backrest frame. In another aspect, both the seat and the backrest can include the mesh. Whether one of the seat or the backrest or both include mesh can depend on the needs of the user. In addition, the sheet of mesh 44 can be held taut across and substantially cover an opening in an all-plastic hoop 48 fixed between the frame sides. For example, the seat can include an all-plastic seat hoop 52 and the backrest can include an all-plastic backrest hoop 56. The resiliency in the seat and backrest can be suited to the user's preference. In one aspect, the mesh of the seat can be stretched 4.5 to 5%, while the mesh of the backrest can be stretched 2.7 to 3.2%. Thus the backrest can have greater deflection and a softer feel because the loading on the backrest is not as great as the seat. In addition, the mesh can have variable tension along a longitudinal direction (front to back for the seat or top to bottom for the backrest) to provide for great comfort. The degree of lateral tension of the mesh of the backrest can vary along the height or elevation of the backrest to create lumbar support at a desired location. The mesh suspended between the hoops can provide greater comfort than traditional solid plastic or solid metal chairs while maintaining stackability and high density storage of folding chairs. Similarly, the mesh can have variable lateral (side-to-side) tension. The all-plastic hoops can be formed by injection molding plastic, and may be formed of, or can include, polypropylene or nylon or ABS. In one aspect, the hoops can be formed of nylon and the seat hoop 52 can weigh less than 2.5 lbs, the backrest hoop 56 can weigh less than 1.5 lbs, and together can weigh less than 4 lbs, to reduce the weight of the chair while providing sufficient strength. In another aspect, the hoops can be formed of nylon and the seat hoop can weigh less than 2 lbs, the backrest hoop can weigh less than 1 lbs, and together can weigh less than 3 lbs. In another aspect, the hoops can be formed of polypropylene and the seat hoop can weigh less than 2 lbs, the backrest hoop can weigh less than 1 lbs, and together can weigh less than 3 lbs. In another aspect, the hoops can be formed of polypropylene and the seat hoop can weigh less than 1.6 lbs, the backrest hoop can weigh less than 0.8 lbs, and together can weigh less than 2.4 lbs. The amount or weight of the plastic material of the all-plastic hoops is balance to provide sufficient strength to the frame and the sheet of mesh or plastic, while also reducing the weight of the chair. Such a configuration as described above can support a static load of at least 1250 lbs. In another aspect, it is believed that sufficient strength can be provided by a seat hoop with a weight as low as 1.25 lbs, a backrest hoop with a weight as low as 0.5 lbs, and a combined weight as low as 1.75. The all-plastic hoops are all-plastic in that they do not have any internal or external metal reinforcement members, although the plastic of the hoops can have fillers such as glass fibers. Thus, the seat and/or backrest hoops support both the mesh and the frame, reducing the number of parts and cost of the chair. The mesh 44 can be bonded, such as chemically or adhesively, in a channel 60 (FIG. 13) in the hoops, such as by melting the material of the mesh and the hoops together, or by chemical reaction, or with adhesive, or the like. Thus, the sheet of mesh can be attached to the hoop without mechanical fasteners, such as staples. (The mesh is represented by 44 in FIG. 1. Most of the mesh has been removed from the figures for clarity of the chair, seat, backrest and hoops. But the mesh extends across the entire opening of the hoops 48.)

The mesh 44 of the seat 14 and backrest 18 held taut in the hoops provide the comfort of an upholstered comfort in a non-upholstered folding chair; while the hoops 48 can provide the sole, or only, structural support between the frame sides above the bottom thereof, or above the front and rear lower cross members 38 and 40. As described above, the hoops can provide the support for both the mesh and the frame sides of the folding chair. The all-plastic hoop 56 of the backrest provides the sole structural support between the backrest supports 30*a* and 30*b* of the frame sides 22*a* and 22*b*. Similarly, the all-plastic hoop 52 of the seat provides the sole structural support between the frame sides 22*a* and 22*b* at a middle of the chair or frame sides. Together, the all-plastic hoops 52 and 56 of the seat and backrest provide the sole structural support between the frame sides 22*a* and 22*b* above the bottom of the frame where the lower cross members 38 and 40 are located. The hoops can be directly coupled to the frame sides, without intervening support members. The seat hoop 52 can be coupled to the frame sides, or front and rear legs, by rivets which also form pivot points. The backrest hoop 56 can couple to the backrest supports as described below. The hoops can be injection molded nylon with a total weight of less than 3 lbs to provide both light weight for ease of folding and unfolding and moving the chairs, and strength to support the taut mesh across the opening and support the frame sides.

The seat 14 and/or seat hoop 52 can be sized and shaped for both comfort and structural support. The seat hoop 52 can have opposite, parallel, substantially straight, hoop sides 64*a* and 64*b* coupled to the frame sides. A front 68 extends between the hoop sides and the front and/or front ends of the frame sides can arc downward (with respect to the chair in the unfolded seating position), or form an arc. The sheet of mesh 44 held taut between the seat hoop forms a longitudinal convex arc (represented at 72) at the front defining a leg relief near the front of the hoop of the seat. The mesh arc 72 or thigh support can have a broad downward curvature to provide comfort to the user's thighs when seated. The seat hoop 52 can have a substantially square shape with rounded corners. The front 68 of the seat hoop 52 can curve forwardly out of the square shape and downwardly out of the plane of the square.

Figure 3:
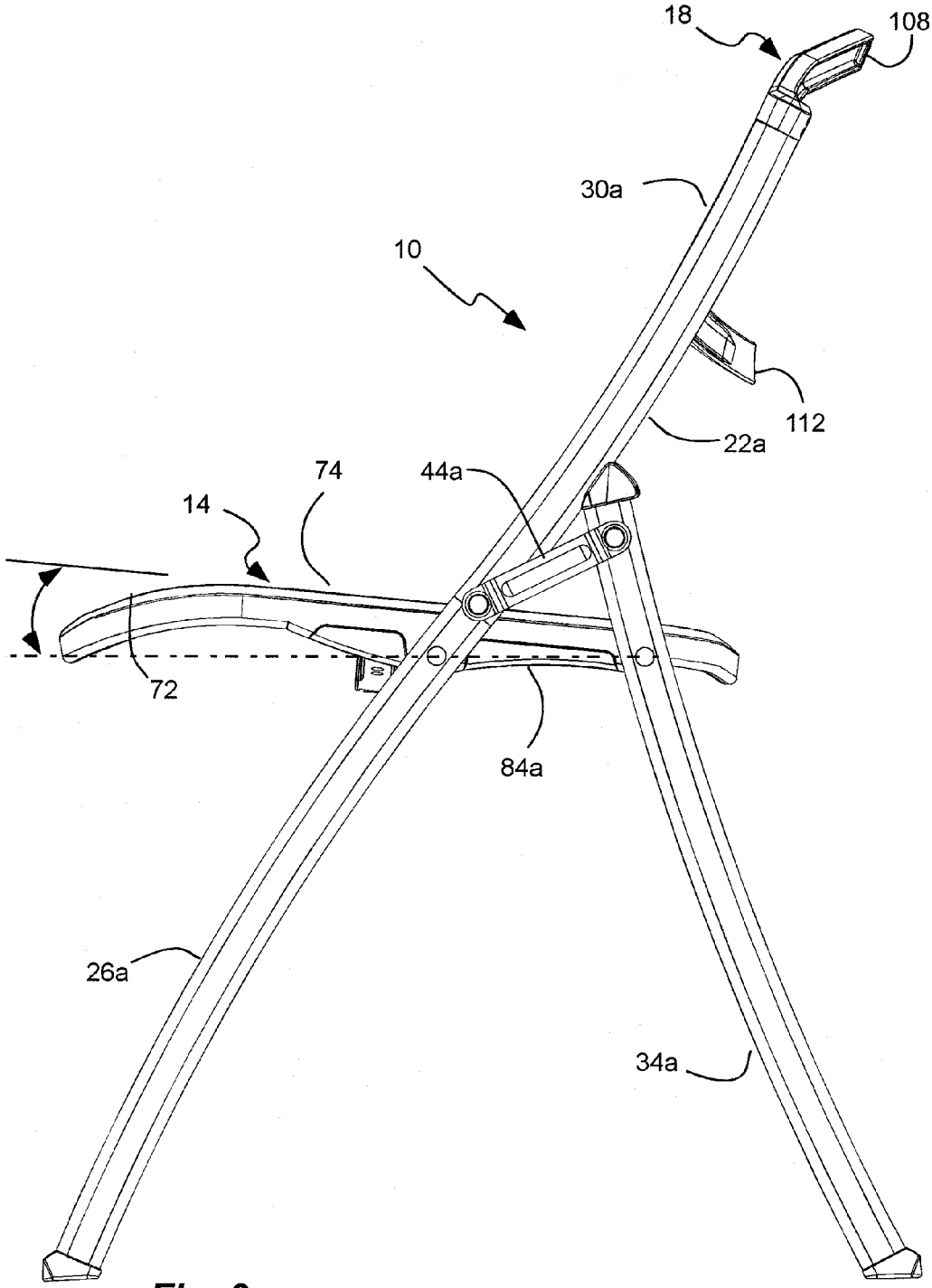
FIG. 3 is a side view of the mesh folding chair of FIG. 1.
Figure 4:
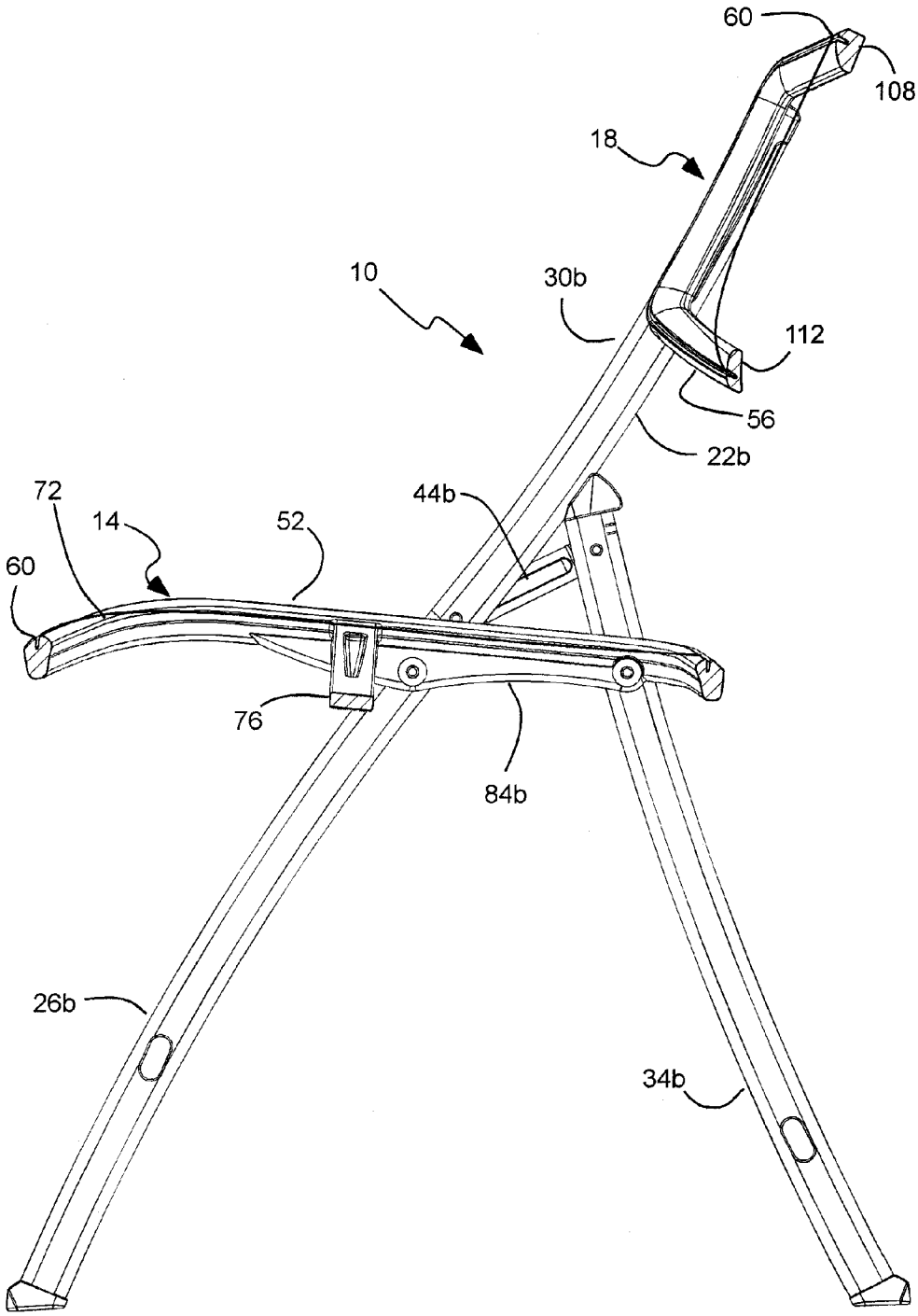
FIG. 4 is a cross-sectional side view taken along line 4-4 of the mesh folding chair of FIG. 1.
Figure 5:
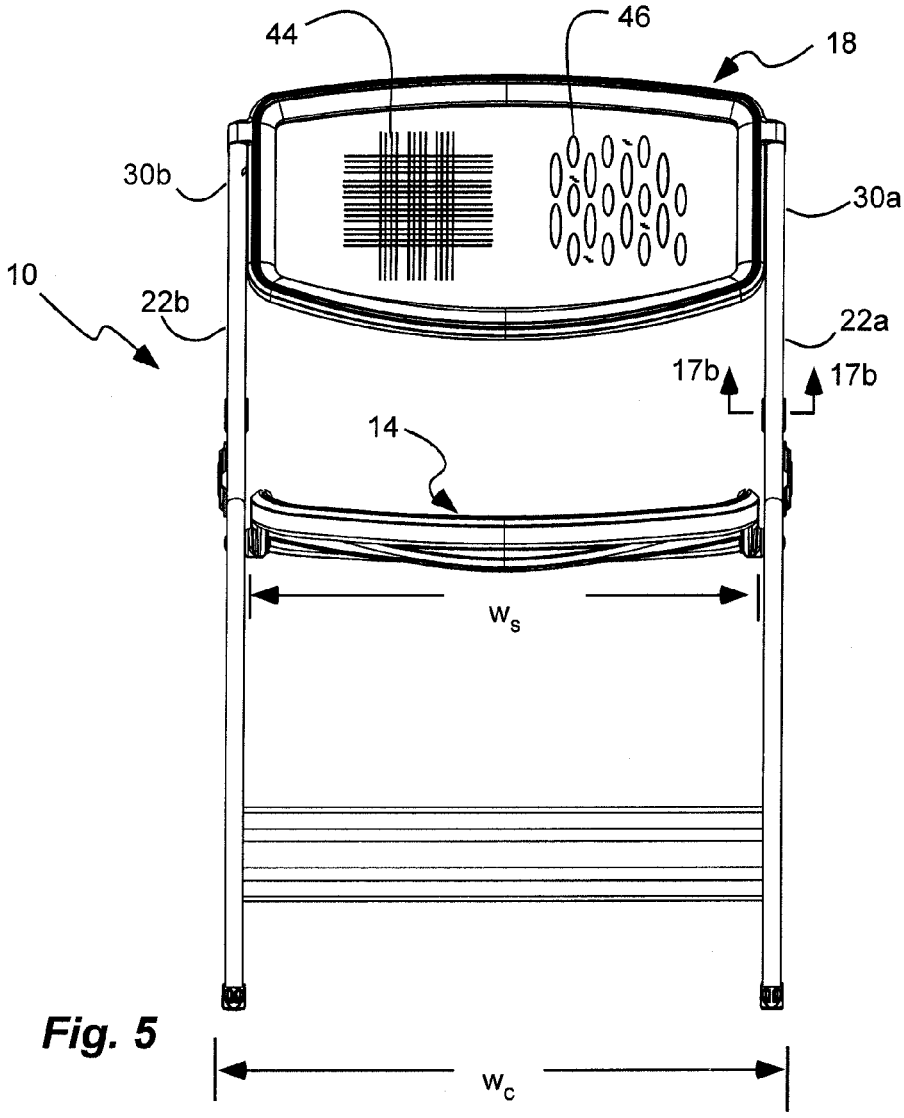
FIG. 5 is a front view of the mesh folding chair of FIG. 1.
Figure 6:
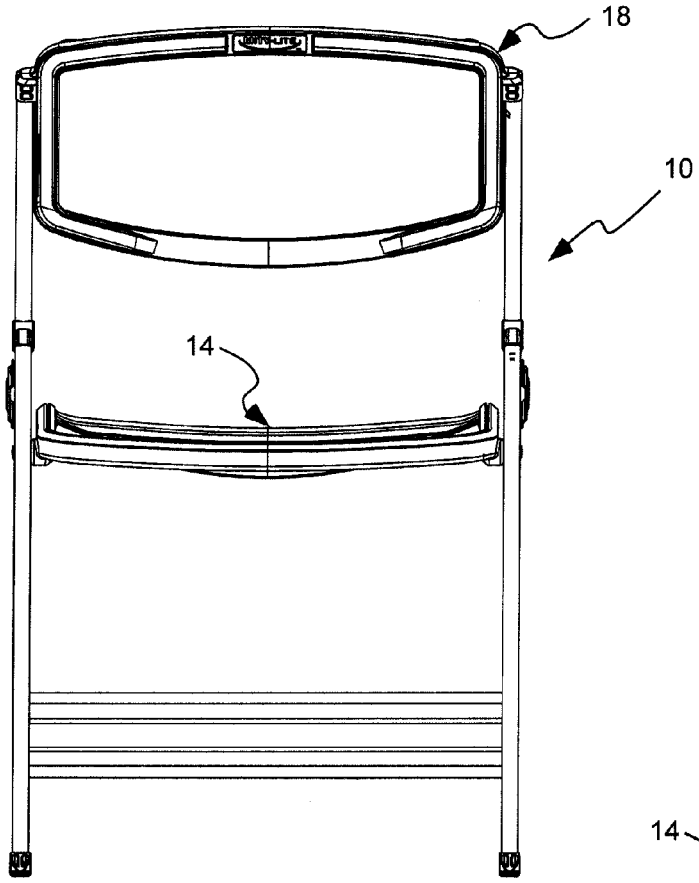
FIG. 6 is a rear view of the mesh folding chair of FIG. 1.
Figure 7:
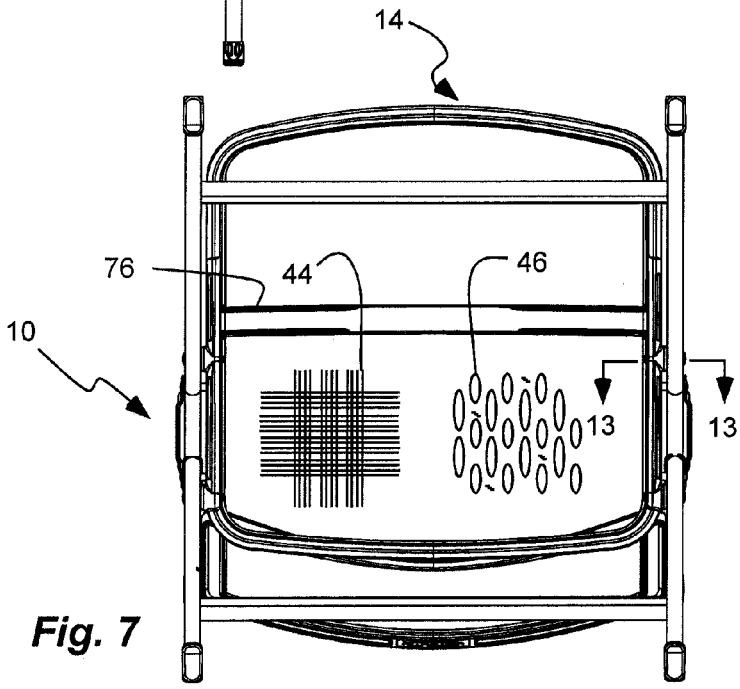
FIG. 7 is a bottom view of the mesh folding chair of FIG. 1.

An upper surface 74, or majority thereof, of the seat is oriented at an incline with respect to horizontal in the unfolded seating position, as shown in FIG. 3. The seat can be inclined between 3-7 degrees, or approximately 5 degrees, with respect to horizontal. The incline of the surface of the seat in combination with the deflection of the mesh form a more comfortable seating surface. The seat can be pivotally coupled to the frame sides by a pair of pivotal couplings including the front leg pivotally coupled to the lobe 84*a* and 84*b* described below and the rear leg pivotally coupled to the seat. The upper surface of the seat disposed at an incline angle of between 3-7 degrees with respect to the pair of couplings due to the lobe. The width $w_s$ of the seat and/or seat hoop at a perimeter of the hoop is equal to or greater than 17 inches. In another aspect, the width of the seat and/or seat hoop at a perimeter of the hoop is equal to or greater than 17.5 inches. The width in combination with the mesh forms a more comfortable seating surface. The width $w_c$, of the chair at an outside of the opposite frame sides is equal to or greater than 19 inches. Thus, the chair combines comfort with a compact size for storage.

The seat hoop 52 can also include a rigid plastic seat-support bar 76 laterally traversing the seat hoop to provide support to the seat hoop and frame sides. As a user sits on the mesh 44 of the seat 14, the mesh pulls inwardly on the seat hoop 52, and thus the frame sides 22*a* and 22*b*; which is resisted by the seat-support bar 76. The bar has an arcuate shape that curves downwardly from the sides to the center and into which the mesh of the seat can deflect when a user sits on the seat. Each side of the bar 76 can have a pair of vertical, parallel, spaced-apart flanges 80 (FIG. 12) extending from each lateral side of the bar adjacent the seat hoop 52. The flanges 80 can taper forming a tapered profile when viewed from the front. The taper can be thicker at the lateral sides and thinner intermediate the lateral sides. The bar 76 can be formed with the hoop 52.

As described above, the all-plastic seat hoop 52 can be directly coupled to the frame sides 22*a* and 22*b* without external support members. A pair of lobes 84*a* and 84*b* can extend downwardly from lateral sides of the seat hoop 52 in the unfolded seating position. Each frame side 22*a* and 22*b*, or front and rear legs, can be pivotally coupled to a different one of the lobes 84*a* and 84*b* respectively. The lobes can be formed by plastic along with the chair hoop. Integral plastic spacers 88 (FIG. 13) can extend laterally beyond the chair hoop towards and abutting to the frame sides, or front and rear legs, to form a space between the frame sides and the chair hoop. The spacers can facilitate pivotal motion between the seat and the frame sides. The spacers form a bearing surface and can reduce part count by replacing traditional separate washers. The spacers can be integrally formed with the chair hoop or lobes. A bore 92 (FIG. 13) extends through the spacers in the lobes and receives a mechanical fastener, such as a rivet 96. The rivet 96 can extend through the bore in the lobes and spacers, and through the frame sides or front and rear legs. The seat can pivot about the rivets with respect to the frame sides or front and rear legs. A recess 100 or counter bore can be formed about the bore adjacent to the frame side to facilitate insertion of the rivet during assembly.

The seat 14 and/or seat hoop 52 forms a four-bar, four-pivot linkage on each side along with the front leg 26*a* and 26*b*, the rear leg 34*a* and 34*b*, and the link 44*a* and 44*b*. As described above, the seat hoop 52 is all-plastic. The front and rear legs, and the links, can be non-plastic, such as steel or aluminum. Thus, the seat and/or seat hoop forms a single all-plastic link in the four-bar linkage. The front legs 26*a* and 26*b* and backrest supports 30*a* and 30*b* can be formed of at least 16 gauge steel with an oval or elongated tubular cross section. The rear legs 34*a* and 34*b* can be formed of at least 18 gauge steel also an oval or elongated tubular cross section. The rivets 100 can be at least 5/16". It is believed that the above described configuration provides a sufficient balance of weight savings and strength.

The backrest 18 and/or backrest hoop 56 can be sized and shaped for both comfort and structural support. The backrest hoop 56 can have opposite, parallel, substantially straight, hoop sides 104*a* and 104*b* coupled to the backrest supports 30*a* and 30*b* of the frame sides. A top 108 extends between the top ends of the hoop sides. The top can have an upward curvature. An arcuate bottom 112 extends between bottom ends of the hoop sides. The bottom arcs rearward with respect to the chair and to a greater degree than any arcing of the top in the rearward direction. The bottom of the backrest forms a deeper arc than a top of the backrest. The sheet of mesh 44 forms a lumbar support near the arcuate bottom of the hoop of the backrest. The sheet of mesh 44 stretched taut between the backrest hoop forms an upright convex arc (represented at 116) between the top and the bottom, and a lateral concave arc (represented at 120) between the hoop sides. The backrest hoop 56 can have a substantially square shape with rounded corners. The top 108 of the backrest hoop 56 can curve outwardly out of the square shape in the plane of the square, while the bottom 112 can curve outwardly out the plane of the square.

Figure 18A:
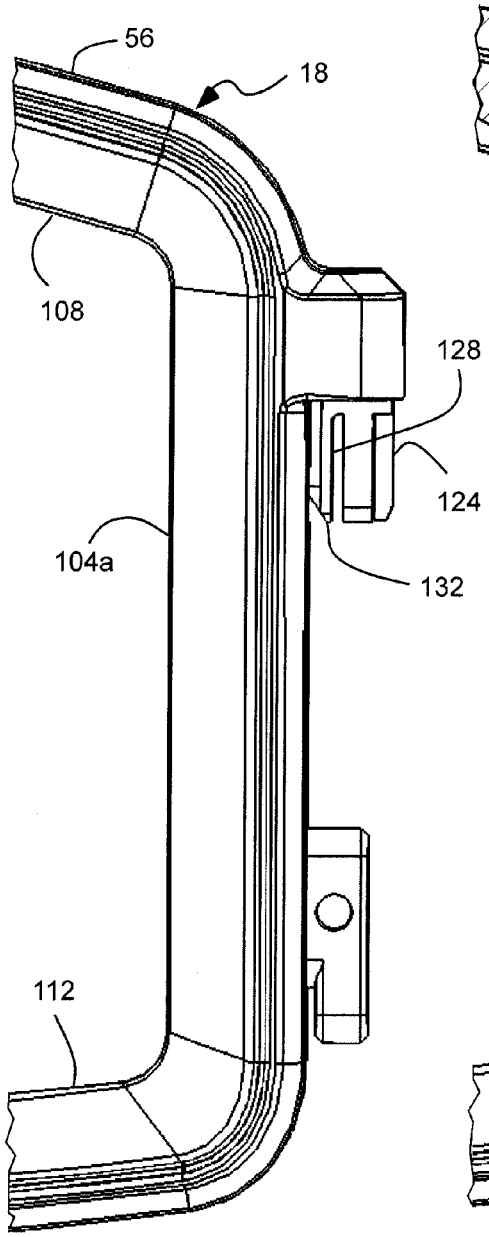
FIG. 18*a* is a partial front view of a backrest in accordance with an embodiment of the present invention of the mesh folding chair of FIG. 1.
Figure 18B:
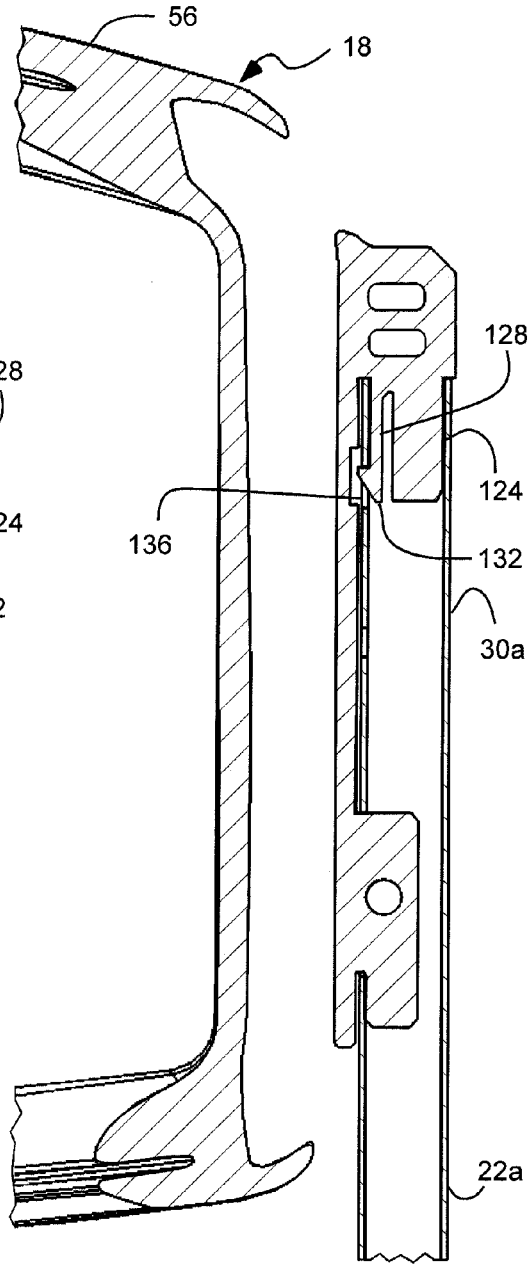
FIG. 18*b* is a partial cross-sectional view taken along line 18*b* of the mesh folding chair of FIG. 1.
Figure 18C:
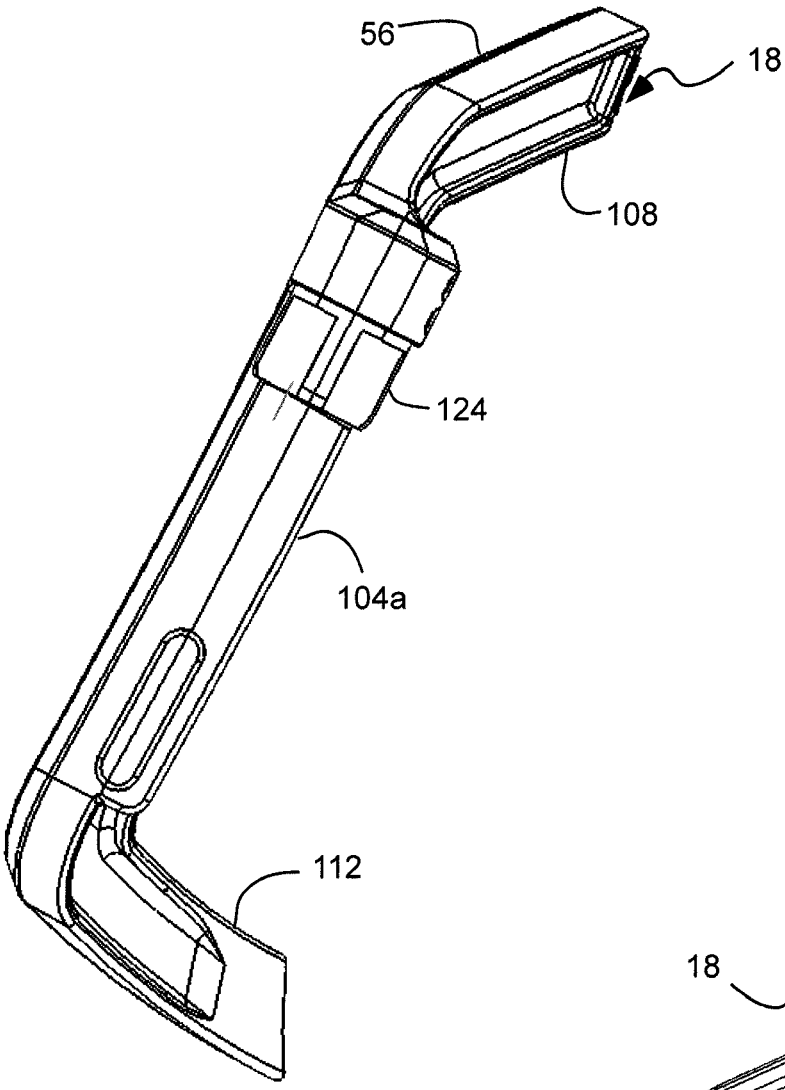
FIG. 18*c* is a side view of the backrest of FIG. 18*a;*
Figure 18D:
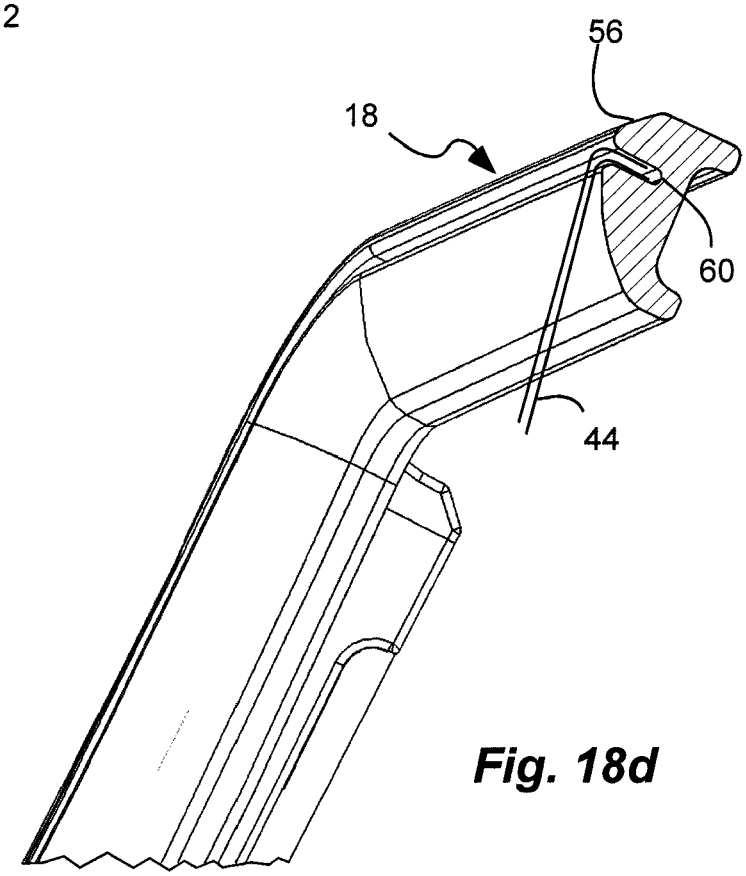
FIG. 18*d* is a partial cross-sectional view taken along line 18*d* of the backrest of FIG. 18*a;*

The all-plastic backrest hoop 56 can be directly coupled to the backrest supports 30*a* and 30*b* of the frame sides 22*a* and 22*b*. As described above, the backrest supports of the frame sides can have a tubular configuration with an open top end. The open top ends can be oriented orthogonal to the tube and can form a flat annular opening. The backrest hoop 56 has a pair of shoulders that extend from the hoop and over the open top ends of the backrest supports to cover the openings. In addition, the backrest hoop includes a pair of opposite side fingers 124 (FIGS. 18*a* and 18*b*) that extend over and into the open top end to provide support between the backrest supports and to cover the open top end. The shoulders and/or fingers can have a step with a larger upper portion covering the tube, or flat annular opening, and a narrower lower portion extending into the tube and abutting the inner surface of the tube. A snap lock is formed between the backrest hoop and the backrest supports. An elongate finger 128 extends from the backrest hoop and into the open top end of the backrest supports. A hook 132 is formed on the finger and extends into a hole 136 in the backrest support. The finger is flexible and an angled surface of the hook can cause the finger to flex or bend inwardly as the finger is inserted into the open top end. The finger is resilient to snap the hook into the hole, while an orthogonal surface of the hook abuts the hole, resisting removal of the finger and hook from the open top end. Additional tabs with enlarged heads and narrow necks can be formed on the backrest hoop to extend into key holes in the backrest supports.

Figure 9:
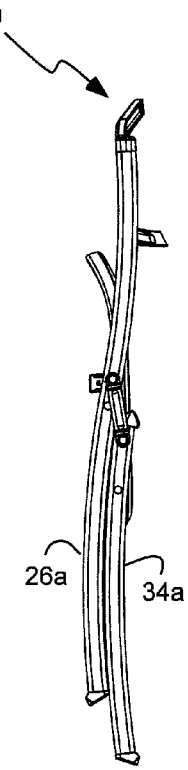
FIG. 9 is a side view of the mesh folding chair of FIG. 1, shown in the folded position.
Figure 10:
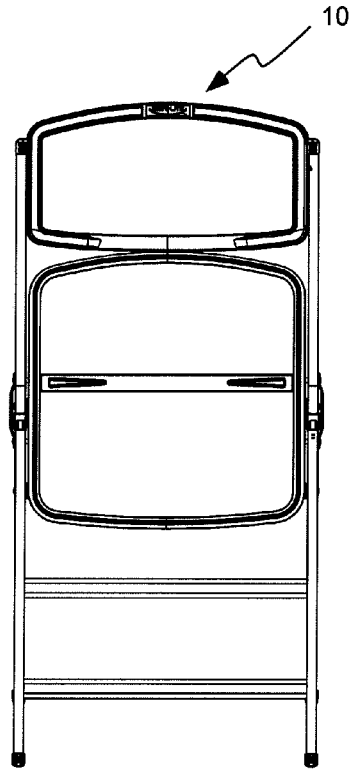
FIG. 10 is a rear view of the mesh folding chair of FIG. 1, shown in a folded position.
Figure 11:
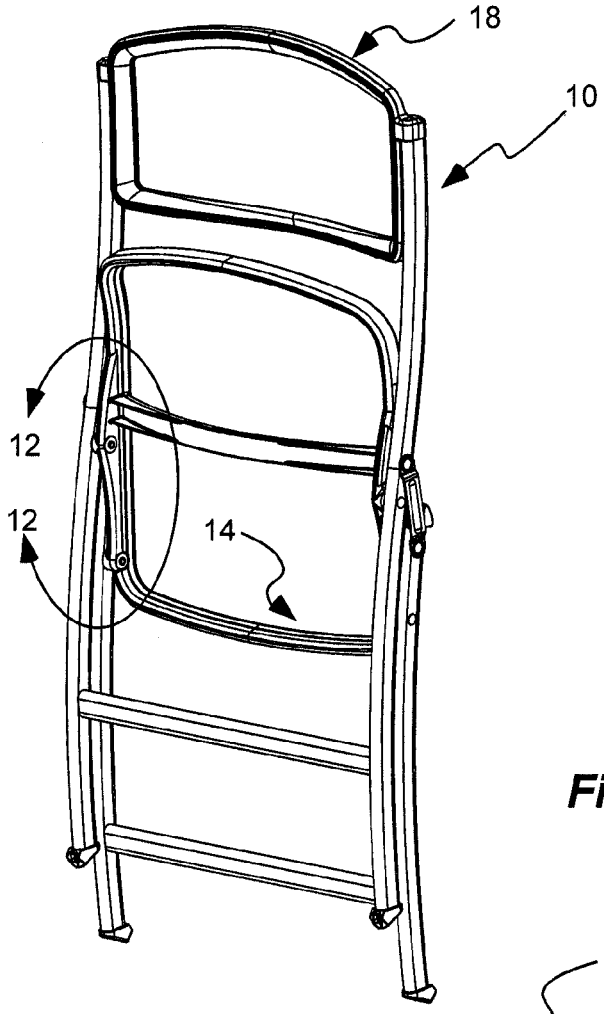
FIG. 11 is a front perspective view of the mesh folding chair of FIG. 1, shown in a folded position.
Figure 12:
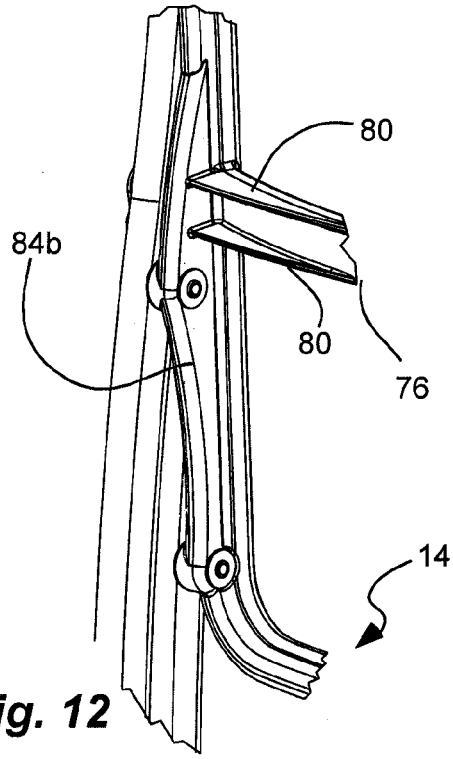
FIG. 12 is a partial front perspective view of the mesh folding chair of FIG. 1, shown in a folded position.
Figure 13:
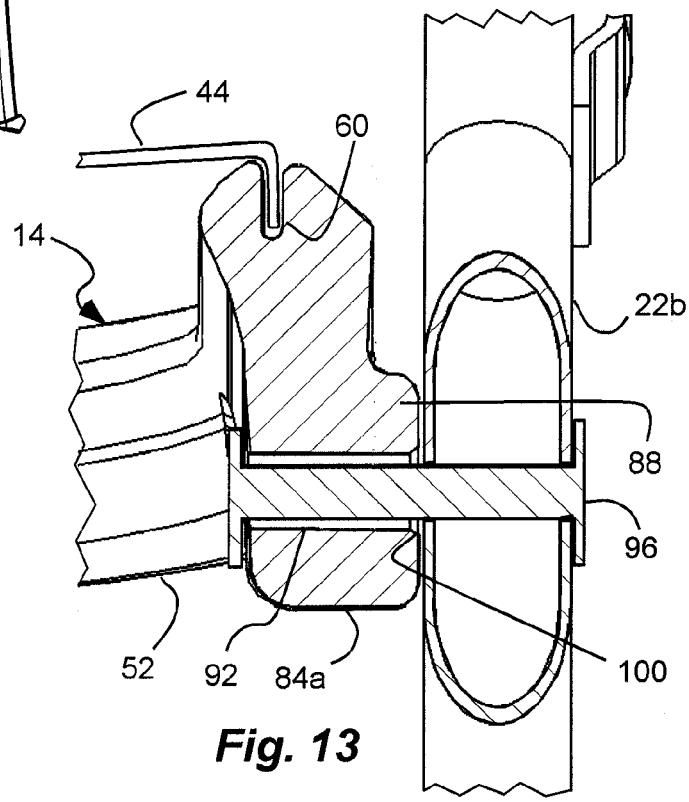
FIG. 13 is a partial front cross-sectional view of the mesh folding chair of FIG. 1.
Figure 14A:
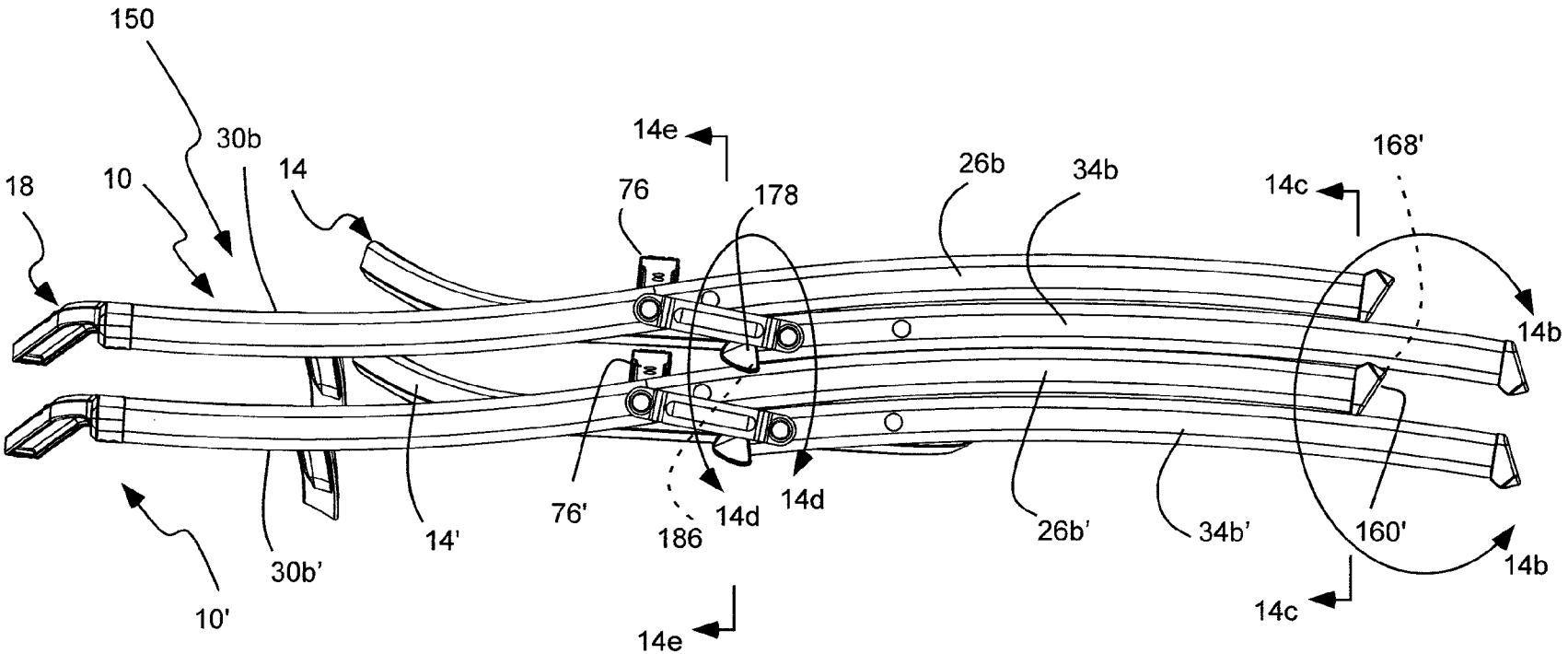
FIG. 14*a* is a side view of a folding and stacking chair system in accordance with an embodiment of the present invention with a plurality of folding and stacking chairs of FIG. 1.
Figure 14B:
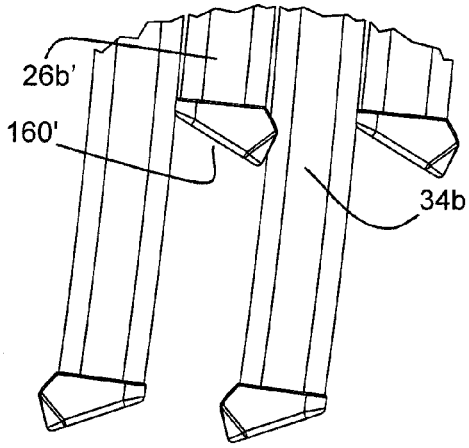
FIG. 14*b* is a partial side view of the folding and stacking chair system of FIG. 14*a;*

Referring to FIGS. 14*a*-17*b*, the chair 10 described above can be part of a folding and stacking chair system, indicated generally at 150, comprising a plurality of folding and stacking chairs. The chairs have an unfolded seating position, as shown in FIGS. 1-7, in which the chairs are configured for sitting upon, and a folded and stacked position, as shown in FIGS. 14*a*-*e*, in which the chairs are folded and stacked together. The front and rear legs can have matching profiles with the rear legs nesting in the profile of the front legs of the same chair in the folded and stacked position, as shown in FIG. 9. In addition, adjacent stacked chairs 10 and 10' have the front legs 26*b*' of one chair 10' nesting in the profile of the rear legs 34*b* of another chair 10 in the folded and stacked position, as shown in FIG. 14*a*. Furthermore, the backrest supports 30*b* and 30*b*' of the adjacent stacked chairs are spaced apart in the folded and stacked position. A front edge of the seat 14' of one chair 10' extends between the backrest supports 30*b* of an adjacent stacked chair 10 in the folded and stacked position. The seat-support bar 76' extends beyond the backrest supports of the frame sides in the folded and stacked position, and toward the adjacent stacked chair 10.

Figure 15C:
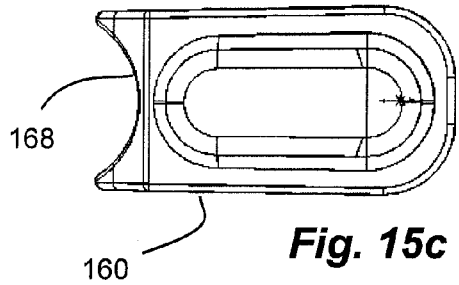
FIG. 15*c* is a top view of the foot of FIG. 15*a;*
Figure 15A:
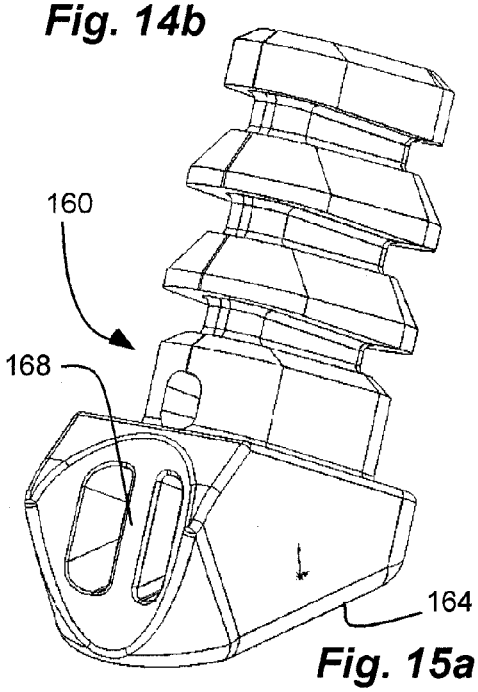
FIG. 15*a* is a perspective view of a foot in accordance with an embodiment of the present invention of the mesh folding chair of FIG. 1.
Figure 14C:
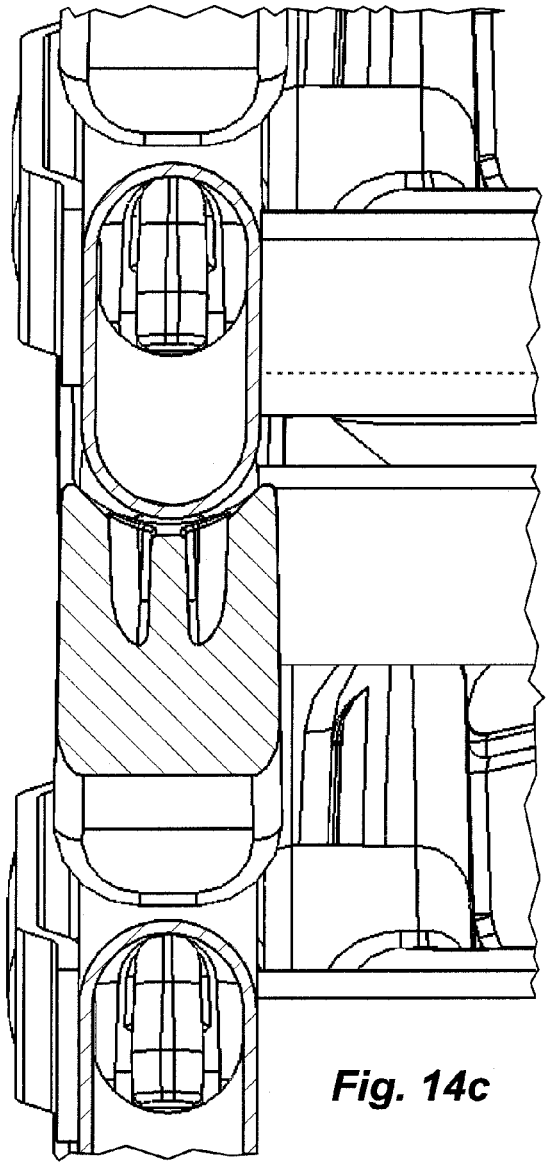
FIG. 14*c* is a partial cross-section view taken along line 14*c* of the folding and stacking chair system of FIG. 14*a;*
Figure 15B:
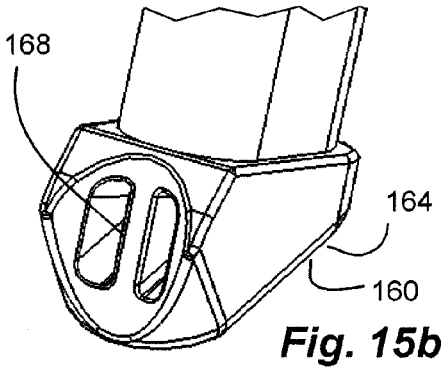
FIG. 15*b* is a partial perspective view of the mesh folding chair of FIG. 1.
Figure 14D:
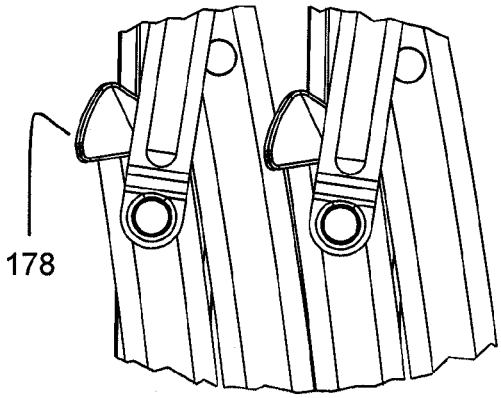
FIG. 14*d* is a partial side view of the folding and stacking chair system of FIG. 14*a;*

Referring to FIGS. 15*a*-*c*, the chair can have feet 160 that provide both a slip and scratch resistant surface, and a stacking aid. The feet for both the front and rear legs can be identical or universal; but with opposite orientations. Each foot 160 has a bottom surface 164 to abut a support surface in the unfolded seating position and oriented at an acute angle with respect to a bottom of the leg. In addition, each foot 160 has a channel 168 oriented transverse to the bottom surface with the channel on the front foot receiving an adjacent stacked leg in the folded and stacked position. An insert portion of the foot can be inserted into an open bottom end of the tubular front and rear legs. The insert portion can be sized to be press fit into the legs. A foot 160' on a front leg 26*b*' of one chair 10' abuts the rear leg 34*b* of the adjacent stacked chair 10, as shown in FIGS. 14*a* and *b*. Adjacent stacked chairs are laterally secured by a rear leg 34*b* of one chair 10 received within a channel 168 on a foot 160' of a front leg 26*b*' of another chair 10'.

Figure 16A:
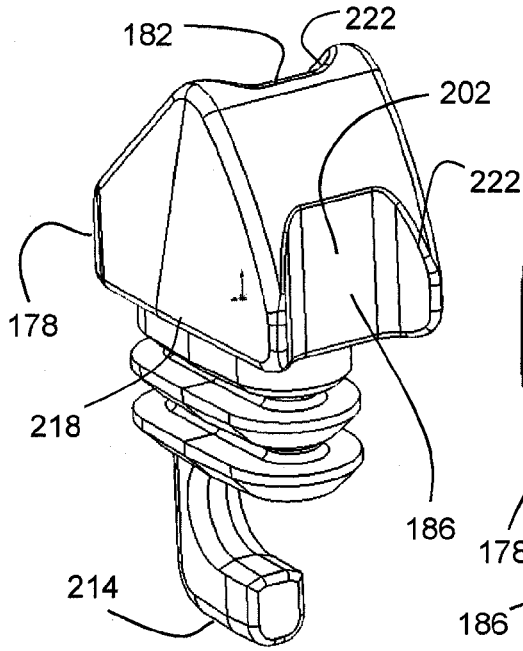
FIG. 16*a* is perspective view of a top stop in accordance with an embodiment of the present invention of the mesh folding chair of FIG. 1.
Figure 16B:
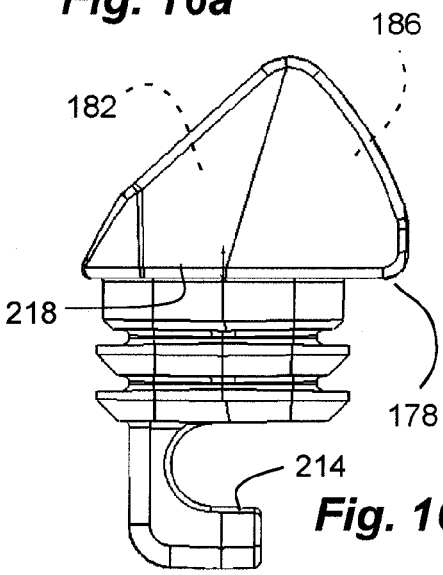
FIG. 16*b* is a side view of the top stop of FIG. 16*a;*
Figure 14E:
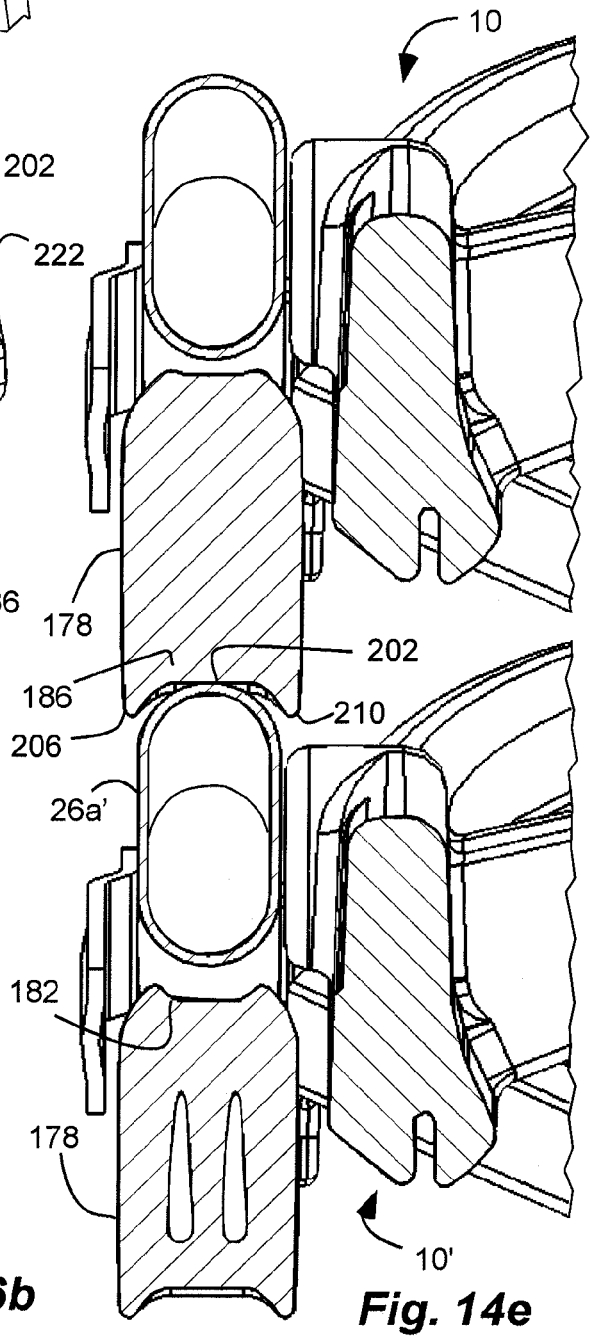
FIG. 14*e* is a partial cross-section view taken along line 14*e* of the folding and stacking chair system of FIG. 14*a;*
Figure 17A:
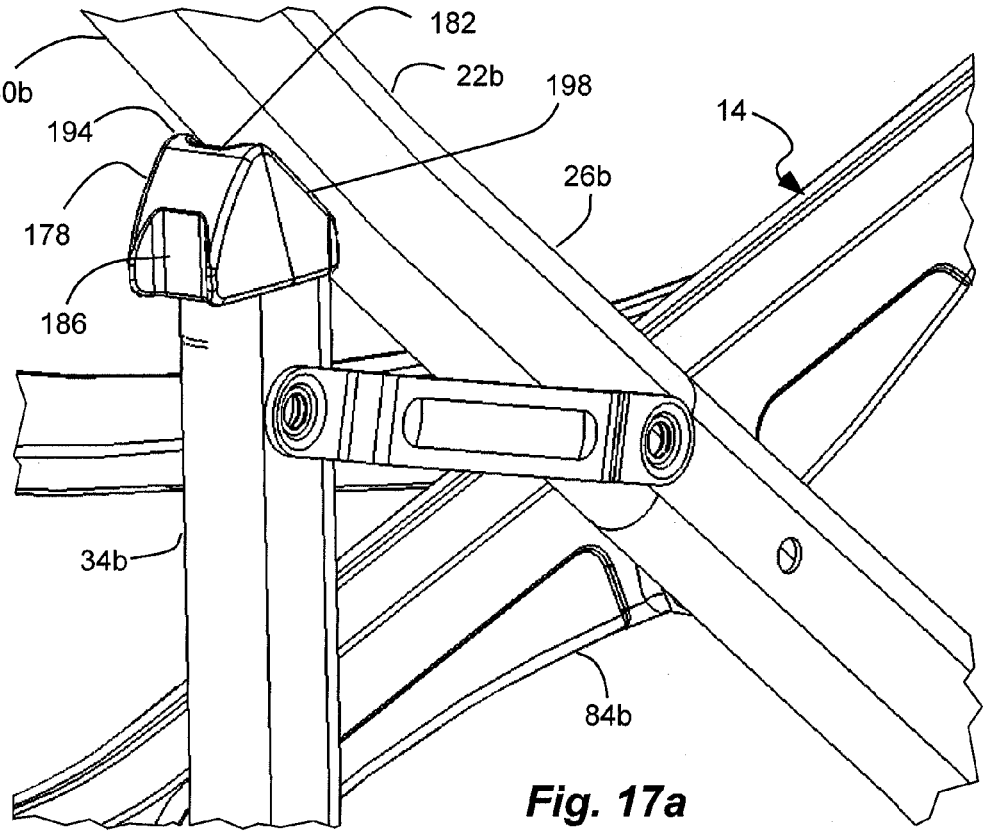
FIG. 17*a* is a partial perspective view of the mesh folding chair of FIG. 1.
Figure 16C:
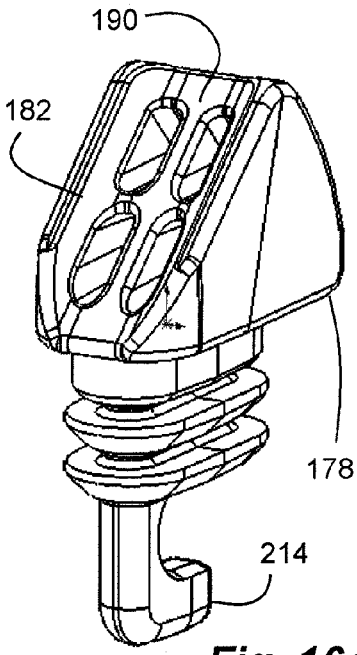
FIG. 16*c* is a perspective view of the top stop of FIG. 16*a;*
Figure 17B:
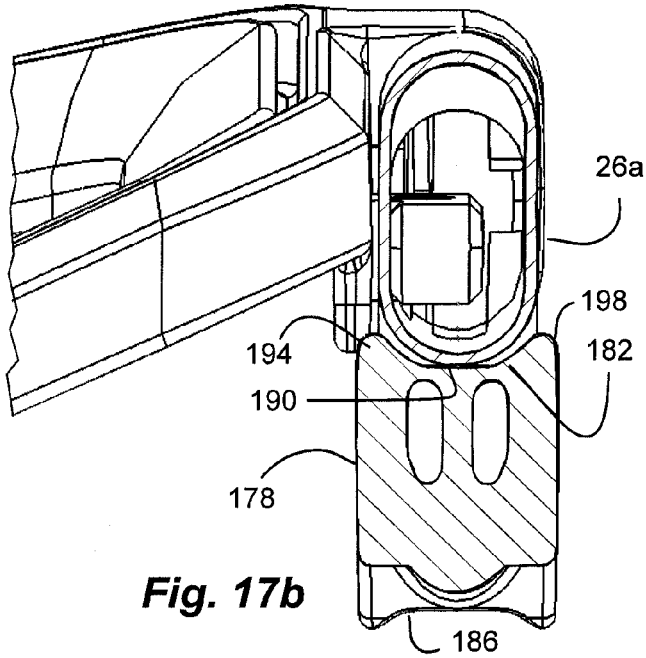
FIG. 17*b* is a partial bottom cross-sectional view taken along line 17*b* of the mesh folding chair of FIG. 1.
Figure 16D:
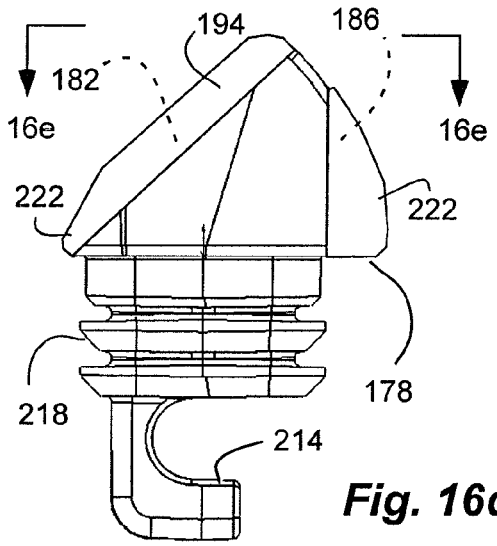
Figure 16E:
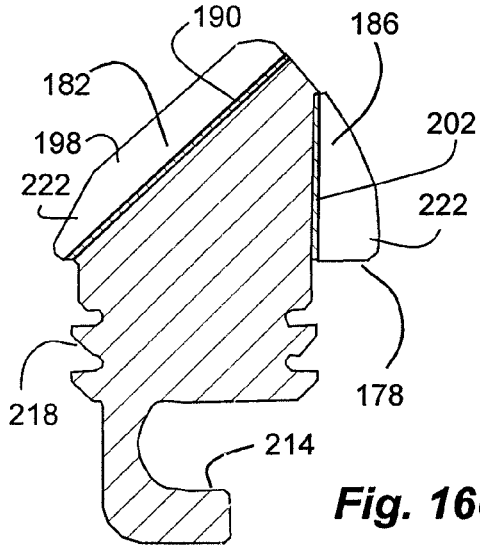

Referring to FIGS. 16*a*-*c*, the chair can have top stops or caps 178 on tops of the rear legs 34*a* and 34*b* that provide an abutment surface between the front and rear legs, support for the front legs, and a stacking aid. The rear legs 34*a* and 34*b* of the frame sides have a tubular configuration with an open top end with a pair of top stops each disposed in a different one of the open top ends of the rear legs. The top stop 178 has opposite channels including a support channel 182 receiving the front leg 26*a* of the same chair in the unfolded seating position, and a stacking channel 186 receiving the front leg 26*a*' of an adjacent stacked chair.

The top stop or bottom of the support channel 182 has an unfolded, support abutment surface 190 (FIGS. 16*c* and 17*b*) to abut the front leg 26*a* of the same chair in the unfolded seating position. In addition, the top stop has an inner support fin 194 (FIGS. 17*a* and *b*) to abut an inner surface of the front leg 26*a* of the same chair in the unfolded seating position to resist inward bowing of the front leg. Thus, the inward force on the seat hoop from the mesh pulls on the front legs, which in turn pushes on the inner fin 194 of the rear legs. Furthermore, the top stop has an outer fin 198 (FIGS. 17*a* and *b*) forming the support channel 182 along with the inner fin 194 to receive the front leg of the same chair.

The top stop or bottom of the stacking channel 186 has a folded, stacking abutment surface 202 (FIGS. 14*e* and 16*a*) to abut the front leg 26*a*' of an adjacent stacked chair. In addition, the top stop has an outer stacking fin 206 (FIG. 14*e*) to abut to an outer surface of the front leg 26*a*' of the adjacent stacked chair to resist movement between adjacent stacked chairs. Furthermore, the top stop has an inner fin 210 (FIG. 14*e*) forming the stacking channel 186 along with the outer fin 206 to receive the front leg of the adjacent stacked chair.

The top stops can have an insert portion for insertion into the open upper end of the rear legs and forming an interference fit. In addition, the top stops can have a rivet hook 214 extending into the rear legs and around a rivet through the rear legs. The top stops can be formed of plastic. The plastic can be flexible to flex and snap around the rivet during assembly. The plastic can include a harder plastic body 218 with a softer plastic 222 disposed over the body, such as on the abutment surface or fins to resist injury to pinched fingers and/or to reduce noise, as shown in FIGS. 16*a* and 16*b*.

Referring again to FIG. 14*a*, adjacent stacked chairs 10 and 10' are separated by a top stop 178 on a rear leg 34*b* of one chair 10 abutting the front leg 26*b*' of another chair 10' and a foot 160' on the front leg 26*b*' of the another chair 10' abutting the rear leg 34*b* of the one chair 10. Separating the front and rear legs of adjacent stacked chairs helps resist damage or marring of the surface finish of the legs and helps resist noise during stacking and unsticking. In addition, adjacent stacked chairs 10 and 10' are laterally secured by a rear leg 34*b* of one chair 10 received within a channel 168' on a foot 160' of a front leg 26*b*' of another chair 10', and the front leg 26*b*' of the another chair 10' received within a stacking channel 186 on a top stop 178 of the rear leg 34*b* of the one chair 10. The channels or fins thereof help maintain the chairs in the stack and resist relative movement of the chairs with respect to one another. Thus, the top stop and foot of adjacent stacked chairs work together When several chairs are stacked and horizontally oriented, a greater portion of the weight or mass of the chairs is located towards the bottom of the chair (or to a lateral side when stacked). This weight keeps the bottom portion of halves of the chairs together when stacked, and keeps the upper portion or halves of the chairs separated from one another, so that the chairs maintain an aligned vertical stack.

The aspects of the chair described above help provide an improved stacking chair; with decreased weight while retaining strength and comfort; while maintaining an affordable and manufacturable chair. The curvilinear profile of the frame and chair legs in the folded configuration and the alignment channels of the top stops and the feet combine to provide a stable and stackable chair. In addition, the mesh stretched between plastic hoops provides comfort and reduces weight while maintaining strength and affordability.

As described above, the seat and the backrest, or the hoops thereof, can be injection molded. The mesh can be secured between the mating hoops and the hoops attached. The seat can be pivotally coupled to the elongated members and rear chair legs, such as with rivets. The backrest can be slid into engagement with the elongated members, and self-locking by the finger.

Referring to FIGS. 19*a-f*, another chair 10*b* is shown which is similar in many respects to that described above, and which description is herein incorporated by reference. In addition, the seat 14*b* has a mesh material 44 stretched between a pair of mating annular hoops, including a bottom (outer) hoop 300 and a top (inner) hoop 304. The hoops 300 and 304 can match or mate together to sandwich the mesh material 44 between the hoops. Similarly, the backrest 18*b* has a mesh 44 material stretched between a pair of mating annular hoops, including a rear (outer) hoop 308 and a forward (inner) hoop 312. The mesh can be stretched and then sandwiched and held between the hoops. For example, the mesh extends over an outer perimeter of the inner hoop and into an interface between the inner and outer hoops.

The pair of mating annular hoops of the seat can include mating annular notches. The mating notches can trap or sandwich the mesh material. The bottom hoop can include an annular notch formed around a top inner perimeter. The top hoop can be received within the annular notch. The top hoop can have an annular flange formed around a bottom inner perimeter and extending within an inner perimeter of the bottom hoop. In addition, the top hoop can have an upper surface 316 that is curved and inclined inwardly for comfort. The mesh material can extend over the top or upper surface of the top hoop and between the hoops. The hoops can be attached by mechanical fasteners, such as screws or staples. In addition, the hoops can be joined by adhesive, sonic welding, etc.

The outer hoop 300 of the seat includes lateral hooks 320 (FIGS. 19*c* and *d*) extending inward with respect to the outer hoop and retaining the inner hoop 304 from pulling inward under tension placed on the sheet of mesh. The lateral hooks can have a channel therein to receive the inner hoop. The lateral hooks allow tension to be placed from the inner hoop onto the outer hoop directly without placing sheer stress on fasteners.

Alternatively, the inner hoop of either the seat or the backrest can have a projection or flange, such as an annular flange, that extends into a channel or groove of the outer hoop, such as a mating annular channel, so that force applied to the inner hoop it transferred to the outer hoop through the mating projection and channel to reduce stress on any fasteners. Alternatively, the projection can be formed on the outer hoop and the channel can be formed on the inner hoop.

Figure 19G:
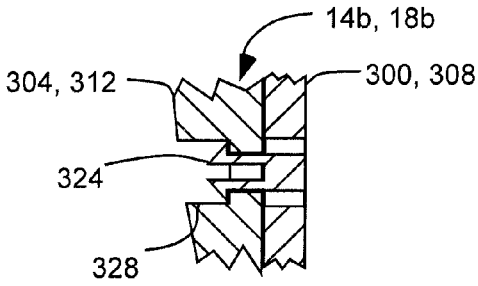
FIG. 19*g* is a partial cross sectional view of a backrest of the mesh folding chair of FIG. 19*a;*
Figure 19A:
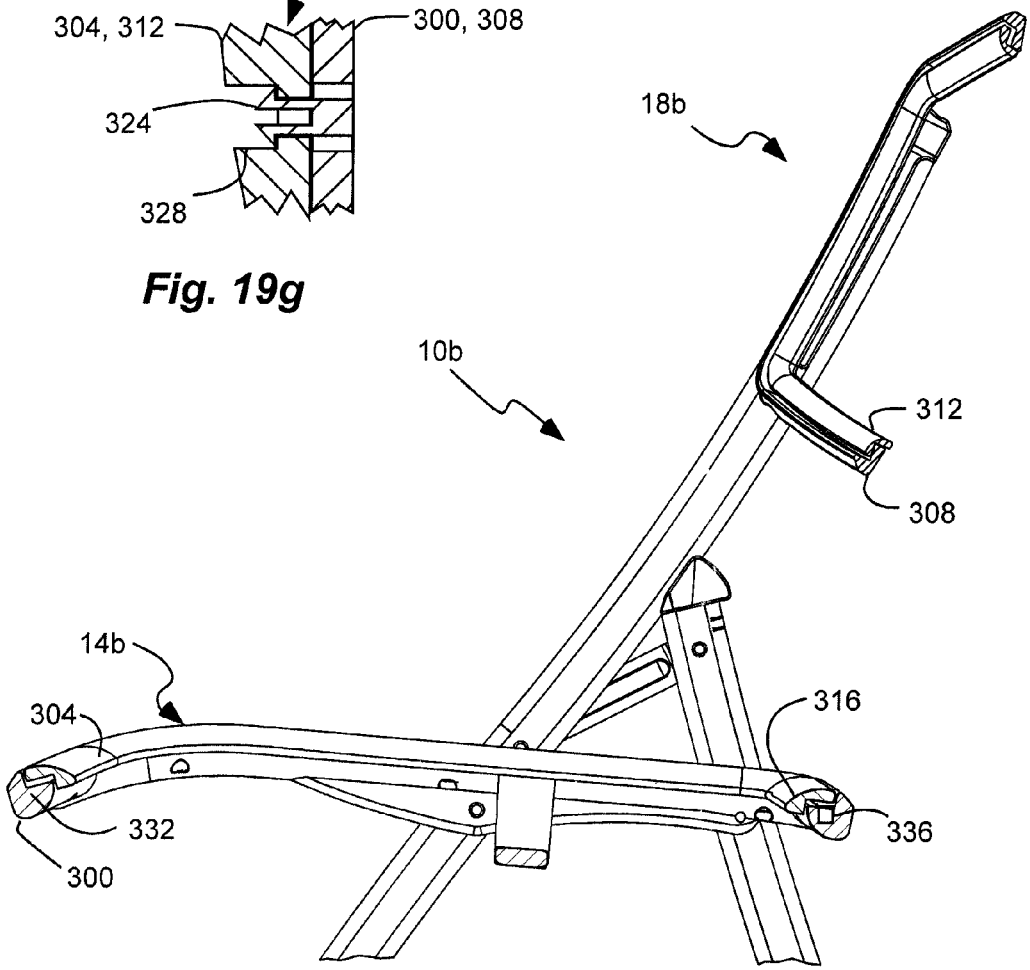
FIG. 19*a* is a cross-sectional side view of another mesh folding chair in accordance with another embodiment of the present invention.
Figure 19B:
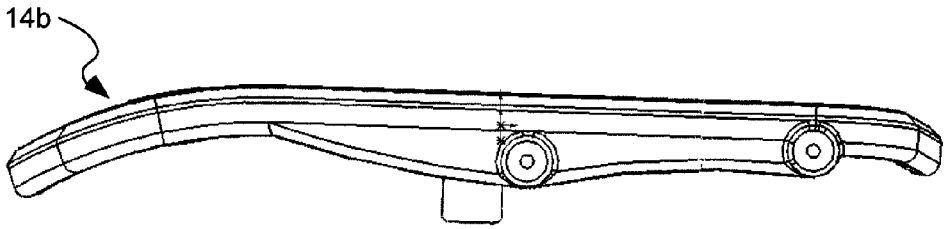
FIG. 19*b* is a side view of a seat of the mesh folding chair of FIG. 19*a;*
Figure 19C:
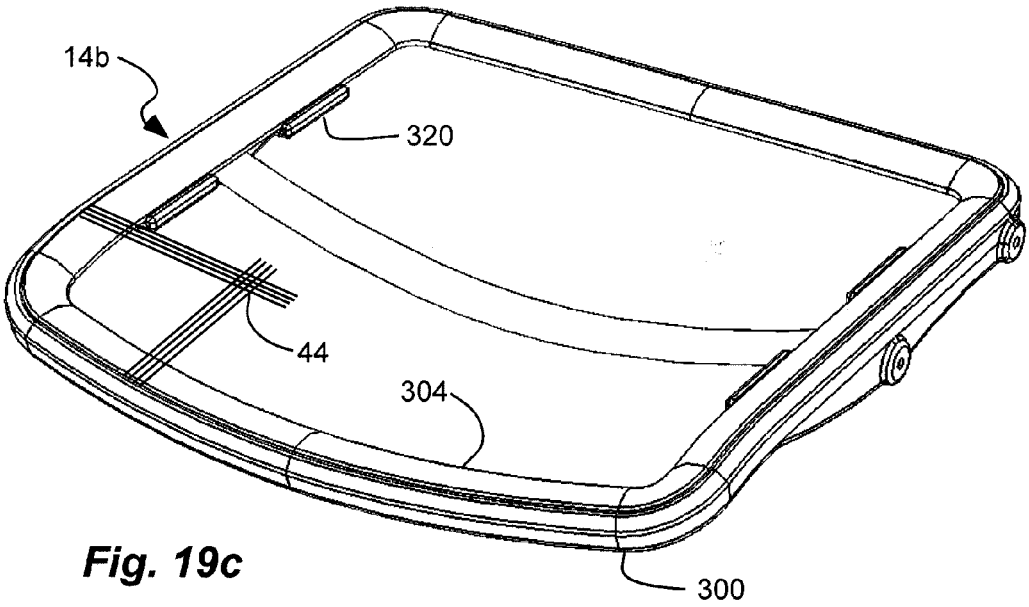
FIG. 19*c* is a perspective view of the seat of FIG. 19*b;*
Figure 19D:
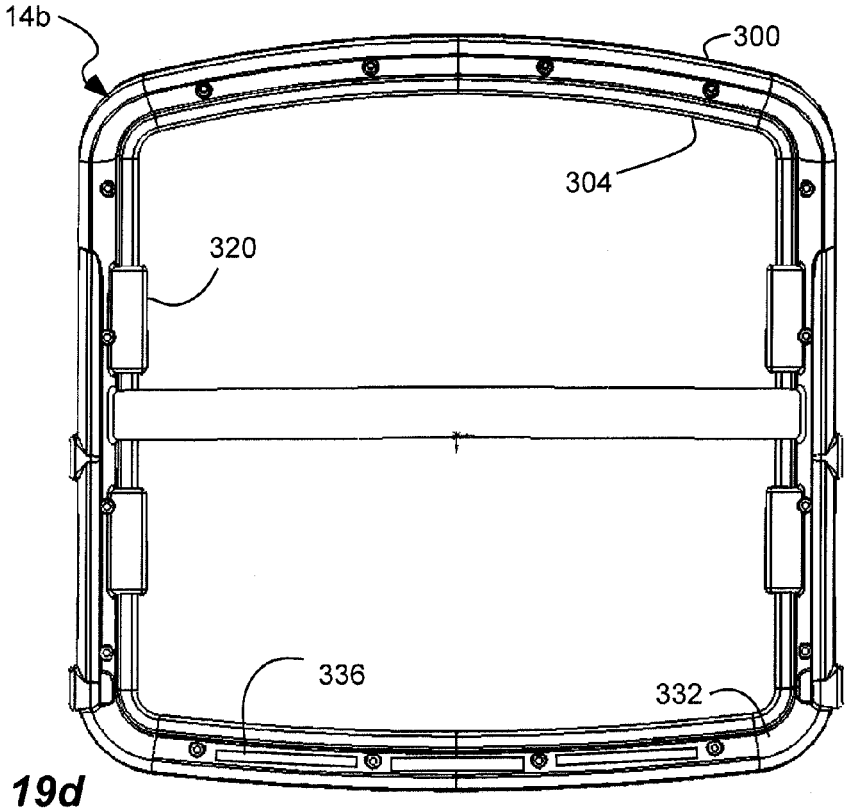
FIG. 19*d* is a bottom view of the seat of FIG. 19*b;*
Figure 19E:
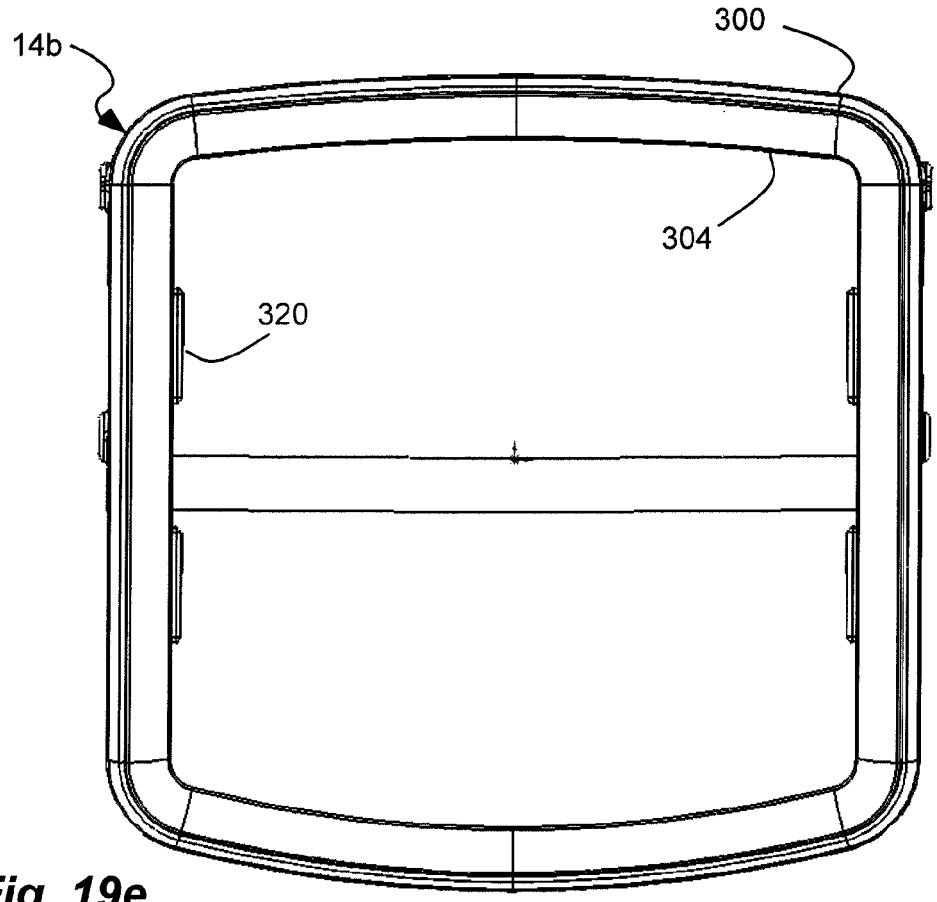
FIG. 19*e* is a top view of the seat of FIG. 19*b;*
Figure 19F:
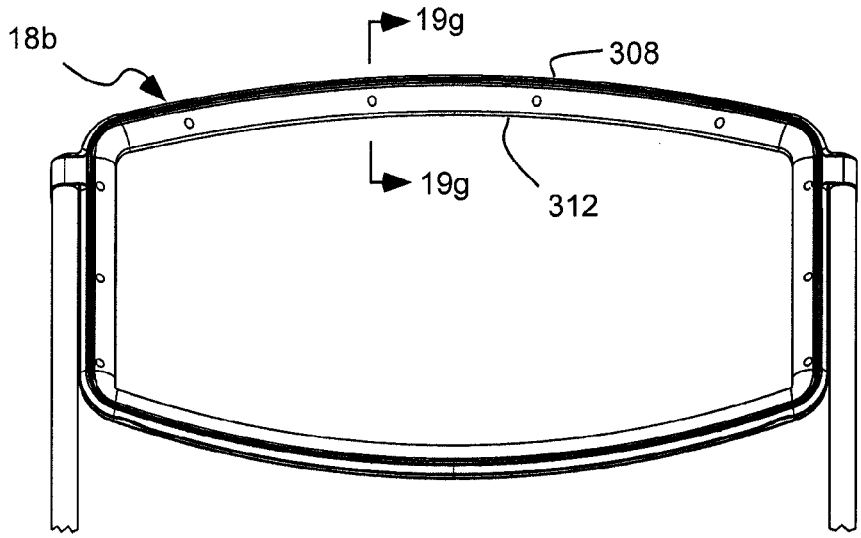
FIG. 19*f* is a partial rear view of the mesh folding chair of FIG. 19*a;*

Referring to FIG. 19*g*, the hoops 300 and 304 and/or 308 and 312 of the seat 14*b* and/or backrest 18*b* can include an integral snap lock fastening system. A plurality of forwardly projecting hooks 324 is formed on either the inner or outer hoop, such as an interior projecting flange formed on the outer hoop 300 and/or 308. The hooks are received in a plurality of notches or apertures 328 formed in the other hoop, such as inner hoop 304 and/or 312. The notches can be recessed in the inner hoop. The plurality of hooks in the plurality of notches retains the inner hoop on the outer hoop. The hooks can include opposite hook pairs facing in opposite directions. The hoop and the plurality of hooks can be formed as a single, integrally formed, plastic unit. Alternatively, the hoops can be attached by mechanical fasteners, such as screws or staples.

The outer hoop 300 of the seat 14*b* includes an interior projecting flange 332. A plurality of cut-outs 336 can be formed in the flange to reduce weight.

Figure 20A:
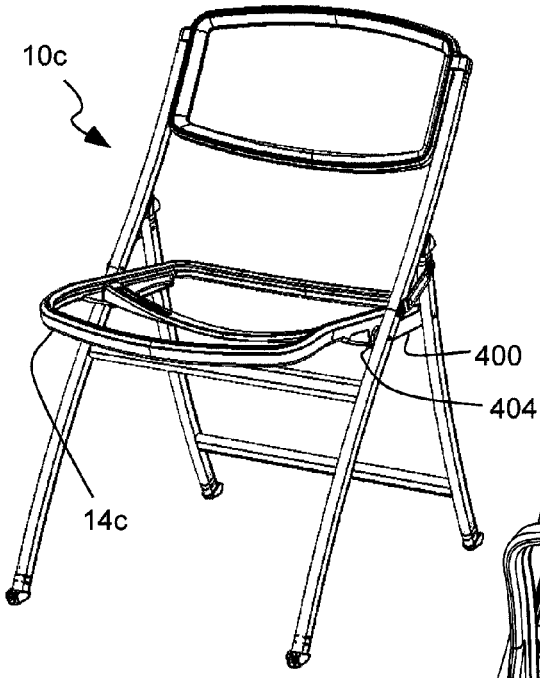
FIG. 20*a* is a perspective view of a mesh folding chair in accordance with another embodiment of the present invention shown with a pivoting seat in an unfolded seating position and with mesh of the seat and backrest mostly removed for clarity.
Figure 20B:
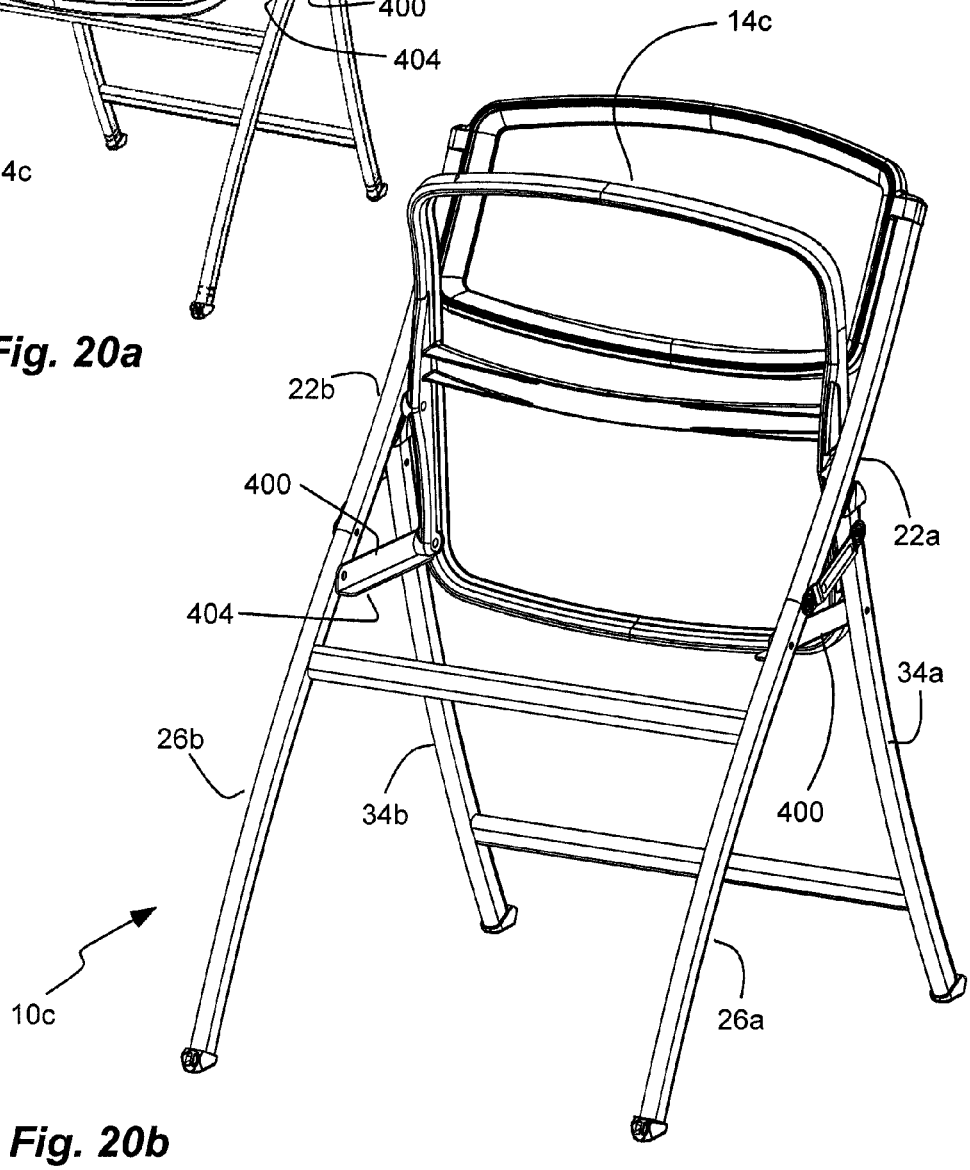
FIG. 20*b* is a perspective view of the mesh folding chair of FIG. 20*a*, shown with the seat in a folded position.

Referring to FIGS. 20*a* and 20*b*, another mesh folding chair 10*c* in accordance with the present invention is shown which is similar in many respects to that described above, and which description is herein incorporated by reference. The chair 10*c* can have a seat 14*c* that pivots with respect to frame sides and back rest when the remainder of the chair is still in the unfolded position. Such a chair can be ganged together with other chairs to form a row of chairs for use in arenas and the like with the seats pivoted to a folded position to increase a passage between adjacent rows. The rear of the seat can be pivotally coupled to the rear legs as described above, but not to the front legs as described above. Instead, a pseudo-seat link 400 can be pivotally coupled between the front and rear legs, in place of the seat. Thus, the pseudo-seat link can take the place of the seat in the four-bar linkage and fold with the chair. The chair can rest on a tab 404 extending from the link to support the seat when the seat is in the unfolded position. The flange holds the weight of the user when the user sits on the seat. The link and flange can be formed of metal.

Although one frame or folding configuration has been described above and shown in the drawings, it will be appreciated that other frame and folding configurations can be used with the mesh seat and/or mesh backrest of the present invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A folding chair, comprising:

a) a seat and a backrest carried between opposite frame sides each with a backrest support, a front leg and a rear leg, and having an unfolded seating position in which the seat pivots to extend from the frame sides and bottoms of the front and rear legs move apart, and a folded position in which the seat pivots toward the frame sides and the front and rear legs move together;

b) the seat having a continuous sheet of flexible and elastic mesh or patterned open texture plastic held across and substantially covering an opening in an all-plastic seat hoop;

c) a pair of plastic lobes formed as one piece with the seat hoop on opposite sides thereof and extending downwardly from the seat hoop in the unfolded seating position;

d) the seat hoop being pivotally coupled between the frame sides with the front legs pivotally coupled to the pair of plastic lobes and the rear legs pivotally coupled to the all-plastic seat hoop; and e) a plastic seat-support bar formed as one piece with the seat hoop and the pair of plastic lobes and laterally traversing the seat hoop and extending from the seat hoop and the pair of plastic lobes in front of the front legs when the seat hoop is in the unfolded seating position.

2. A chair in accordance with claim 1, wherein the backrest has a continuous sheet of flexible and elastic mesh or patterned open texture plastic held across and substantially covering an opening in an all-plastic backrest hoop; and the all-plastic backrest hoop and the all-plastic seat hoop form the sole structural support between the frame sides above a bottom of the frame sides near a lower end of the front and rear legs.

3. A chair in accordance with claim 1, wherein the backrest has a continuous sheet of flexible and elastic mesh or patterned open texture plastic held across and substantially covering an opening in an all-plastic backrest hoop; and the all-plastic backrest hoop forms the sole structural support between the backrest supports of the frame sides.

4. A chair in accordance with claim 1, wherein the all-plastic seat hoop forms the sole structural support between the frame sides at a middle of the frame sides.

5. A chair in accordance with claim 1, further comprising:

a space separating the seat and the backrest and defining a gap between the sheet of mesh or plastic of the seat and a sheet of mesh or plastic of the backrest, and into which the seat folds in the folded position.

6. A chair in accordance with claim 1, wherein the seat-support bar further comprises:

a pair of parallel flanges extending at least partially from each lateral side of the bar adjacent the hoop of the seat forming a tapered profile when viewed from the front which is thicker at the lateral sides and thinner intermediate the lateral sides.

7. A chair in accordance with claim 1, wherein the all-plastic seat hoop is directly coupled to front and rear legs without intervening support members.

8. A chair in accordance with claim 1, further comprising:

a plurality of integral plastic spacers formed with the all-plastic seat hoop and the pair of plastic lobes and extending laterally beyond the all-plastic seat hoop and abutting the front legs or the rear legs to form a space between the front legs or the rear legs and the all-plastic seat hoop and the pair of plastic lobes.

9. A chair in accordance with claim 8, wherein the spacers further comprise:

a bore therethrough to receive a fastener; and a recess formed about the bore adjacent to the front legs or the rear legs.

10. A chair in accordance with claim 1, wherein the sheet of mesh is bonded into the all-plastic seat hoop.

11. A chair in accordance with claim 1, wherein the sheet of mesh or plastic is attached to the all-plastic seat hoop without mechanical fasteners.

12. A chair in accordance with claim 1, wherein the sheet of mesh includes an elastomeric material.

13. A chair in accordance with claim 1, wherein the all-plastic seat hoop includes polypropylene or nylon or ABS.

14. A chair in accordance with claim 1, wherein the all-plastic seat hoop weighs between 1.25-2.5 lbs.

15. A chair in accordance with claim 1, wherein the backrest has an all-plastic backrest hoop, and wherein the all-plastic backrest hoop weighs between 0.5-1.5 lbs.

16. A chair in accordance with claim 1, wherein the all-plastic seat hoop and an all-plastic backrest hoop together weigh between 1.75-4 lbs.

17. A chair in accordance with claim 1, wherein each frame side further comprises:

a link pivotally coupled between the front and rear legs; and the link, the front leg, the rear leg, and the all-plastic seat hoop forming a four-bar, four-pivot linkage.

18. A chair in accordance with claim 17, wherein the link, the front leg and the rear leg are formed of non-plastic material and the seat hoop forms a single all-plastic link in the four-bar linkage.

19. A chair in accordance with claim 1, wherein the backrest support and the front leg are formed of at least 16 gauge metal and the rear leg is formed of at least 18 gauge metal; and wherein the seat and the backrest are coupled to the opposite frame sides with at least 5/16 inch rivets.

20. A chair in accordance with claim 1, wherein the backrest supports of the frame sides have a tubular configuration with an open top end;

an all-plastic backrest hoop has a pair of shoulders extending from the backrest hoop and over the open top end of the backrest supports to cover the open top end; and the all-plastic backrest hoop has a pair of opposite side fingers that extend from the pair of shoulders and into the open top end to provide support between the backrest supports.

21. A chair in accordance with claim 20, further comprising a snap lock between the hoop of the backrest and the backrest supports including:

an elongate finger extending from the hoop of the backrest into the open top end of the backrest supports; and a hook formed on the finger extending into a hole in the backrest support.

22. A chair in accordance with claim 1, wherein the all-plastic hoop of the seat has bearing surfaces that abut the front and rear legs.

23. A chair in accordance with claim 1, wherein the all-plastic seat hoop has opposite, parallel, substantially straight, hoop sides.

24. A folding chair, comprising:

a) a seat and a backrest carried between opposite frame sides each with a backrest support, a front leg and a rear leg, and having an unfolded seating position in which the seat pivots to extend from the frame sides and bottoms of the front and rear legs move apart, and a folded position in which the seat pivots toward the frame sides and the front and rear legs move together;

b) the seat having a continuous sheet of flexible and elastic mesh held taut across and substantially covering an opening in an all-plastic seat hoop;

c) a pair of plastic lobes formed as one piece with the seat hoop on opposite sides thereof and extending downwardly from the seat hoop in the unfolded seating position;

d) the seat hoop being pivotally coupled between the frame sides with the front legs pivotally coupled to the pair of plastic lobes and the rear legs pivotally coupled to the all-plastic seat hoop;

e) a plastic seat-support bar formed as one piece with the seat hoop and the pair of plastic lobes and laterally traversing the seat hoop and extending from the seat hoop and the pair of plastic lobes in front of the front legs when the seat hoop is in the unfolded seating position; and f) the backrest having a continuous sheet of flexible and elastic mesh held taut across and substantially covering an opening in an all-plastic backrest hoop.

25. A folding chair, comprising:

a) a seat and a backrest carried between opposite frame sides each with a backrest support, a front leg and a rear leg, and having an unfolded seating position in which the seat pivots to extend from the frame sides and bottoms of the front and rear legs move apart, and a folded position in which the seat pivots toward the frame sides and the front and rear legs move together;

b) the seat having a continuous sheet of flexible and elastic mesh held taut across and substantially covering an opening in an all-plastic seat hoop;

c) a pair of plastic lobes formed as one piece with the seat hoop on opposite sides thereof and extending downwardly from the seat hoop in the unfolded seating position;

d) the seat hoop being pivotally coupled between the frame sides with the front legs pivotally coupled to the pair of plastic lobes and the rear legs pivotally coupled to the all-plastic seat hoop;

e) a plastic seat-support bar formed as one piece with the seat hoop and the pair of plastic lobes and laterally traversing the seat hoop and extending from the seat hoop and the pair of plastic lobes in front of the front legs when the seat hoop is in the unfolded seating position;

f) the seat hoop having an arcuate shape into which the sheet of mesh of the seat is deflectable;

g) the backrest having a continuous sheet of flexible and elastic mesh held taut across and substantially covering an opening in an all-plastic backrest hoop, the backrest hoop fixed between the backrest supports of the frame sides; and h) the all-plastic backrest hoop and the all-plastic seat hoop form the sole structural support between the frame sides above a bottom of the frame sides near a lower end of the front and rear legs.

* * * * *